US006796647B2

(12) United States Patent
Kosaka et al.

(10) Patent No.: US 6,796,647 B2
(45) Date of Patent: Sep. 28, 2004

(54) METHOD OF FORMING IMAGE ON CARD AND APPARATUS THEREFOR

(75) Inventors: Zenta Kosaka, Matsumoto (JP); Kazuaki Morozumi, Okaya (JP); Kunihiko Matsuhashi, Matsumoto (JP); Yoshiki Minowa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/625,674

(22) Filed: Jul. 23, 2003

(65) Prior Publication Data

US 2004/0125187 A1 Jul. 1, 2004

Related U.S. Application Data

(62) Division of application No. 10/035,040, filed on Dec. 27, 2001, now Pat. No. 6,640,717.

(30) Foreign Application Priority Data

Jan. 11, 2001 (JP) ..... 2001-003829

(51) Int. Cl.[7] ..... B41J 2/01

(52) U.S. Cl. ..... 347/103; 347/100; 347/102; 347/106; 347/108; 101/487; 101/492; 400/120.18; 428/195; 8/467; 8/471

(58) Field of Search ..... 347/1, 4, 100, 347/101, 102, 103, 104, 105, 106, 108; 101/487, 492; 400/120.18; 428/195; 8/467, 468, 470, 471, 472

(56) References Cited

U.S. PATENT DOCUMENTS 5,142,722 A * 9/1992 Kolb ..... 8/471
5,284,816 A * 2/1994 Stephenson ..... 428/195
5,392,059 A * 2/1995 Ueno et al. ..... 347/188
5,448,282 A * 9/1995 Imai et al. ..... 347/213
5,489,567 A * 2/1996 Koshizuka et al. ..... 428/195
5,634,731 A * 6/1997 Kita et al. ..... 400/120.18
5,932,053 A * 8/1999 Asajima et al. ..... 156/235
6,039,480 A * 3/2000 Andoh et al. ..... 400/120.01
6,103,042 A * 8/2000 Hatada et al. ..... 428/195
6,270,933 B1 * 8/2001 Thompson ..... 430/18
6,308,630 B1 * 10/2001 Kurokawa et al. ..... 101/492
6,335,307 B1 * 1/2002 Imai et al. ..... 428/195
6,387,846 B1 * 5/2002 Shinozaki et al. ..... 347/188

FOREIGN PATENT DOCUMENTS

| | | |
|---|---|---|
| EP | 0 870 615 | 10/1998 |
| JP | 09-156212 | 6/1997 |
| WO | 02/02348 | 1/2002 |

* cited by examiner

*Primary Examiner*—Eugene H. Eickholt
(74) *Attorney, Agent, or Firm*—Hogan & Hartson, LLP

(57) ABSTRACT

There are provided a method of forming an image on a card and an apparatus therefor, which are capable of properly carrying out printing of an image on a card and protection of the printed image in a simplified manner without changing the size of the card. A card is used which has an ink-fixing layer laminated on a surface of a substrate layer and an ink image-receiving layer peelably laminated on a surface of the ink-fixing layer. An image is printed on the card, while feeding the card, by an ink jet printing method using a sublimable dye ink. The card printed with the image is conveyed to a heating source, and subjected to heat treatment by the heating source to cause diffusion of the sublimable dye ink held in the ink image-receiving layer in the ink-fixing layer, and color development to form an image. The ink image-receiving layer is peeled off the card after the heat treatment.

8 Claims, 10 Drawing Sheets

METHOD OF FORMING IMAGE ON CARD AND APPARATUS THEREFOR

This is a divisional of application Ser. No. 10/035,040 filed Dec. 27, 2001, and now U.S. Pat. No. 6,640,717 which application is hereby incorporated by reference in its entirety.

BACKGROUND OF THE INVENTION

1. Field of the Invention

This invention relates to a method of forming an image on a card and an apparatus therefor, which are capable of printing on the card by an ink jet printing method by using a sublimable dye ink.

2. Prior Art

Conventionally, there have been proposed a method of forming an image on a card of a general type and an apparatus therefor, which print an image on a card by an ink jet printing method by using a sublimable dye ink. In this method and apparatus therefor, after an image is formed on the card by ejecting a dye ink from an ink jet head, a surface printed with the image is subjected to a lamination process to protect the printed image on the card. The lamination process is carried out by covering the whole front surface of the card with a transparent film and conducting thermal pressing of the card and film, followed by cutting off an undesired portion of the transparent film according to the size of the card in a die-cutting fashion. This makes it possible to enhance the abrasion resistance and rub resistance of the card printed with the image so that the printed image is not damaged even if it is frequently used by the user.

However, in the conventional image forming method and apparatus of the above-mentioned kind, a punch die is required for performing the lamination process, and moreover it is difficult to cut off the undesired portion of the transparent film such that the periphery of the card is not damaged by the punch die. Therefore, the size of the card having been subjected to the lamination process becomes necessarily larger than that of the original one, thereby impairing the convenience for the user. To carry out the lamination process without using a punch die, however, it is necessary to coat the transparent film such that it does not extend from the periphery of the card, which makes it impossible to uniformly protect the top surface of the card.

SUMMARY OF THE INVENTION

It is an object of the invention to provide a method of forming an image on a card and an apparatus therefor, which are capable of printing an image on a card and protecting the printed image in an appropriate and simplified fashion without changing the size of the card.

To attain the above object, according to a first aspect of the invention, there is provided a method of forming an image on a card, comprising the steps of:

printing an image on a card by an ink jet printing method by using a sublimable dye ink while feeding the card, the card having a substrate layer, an ink-fixing layer laminated on a surface of the substrate layer, and an ink image-receiving layer peelably laminated on a surface of the ink-fixing layer, whereby the sublimable dye ink is caused to be held by the ink image-receiving layer;

conveying the card to a heating source; and subjecting the card to heat treatment by the heating source to thereby cause diffusion of the sublimable dye ink held in the ink image-receiving layer in the ink-fixing layer and color development to form an image; and peeling the ink image-receiving layer off the card after the heat treatment.

According to this method, when an image is directly printed on a card by the ink jet printing method by using a sublimable dye ink, ink droplets of the sublimable dye ink are impregnated into the ink image-receiving layer and held therein. In this state, when the card is conveyed to the heating source and heated thereby, the heat treatment causes evaporation and diffusion of the ink deep into the ink-fixing layer as migration particles having sizes at a molecular level, and color development, whereby an image is formed. Then, the ink image-receiving layer is peeled off the card to cause the ink-fixing layer to be exposed. Thus, a card can be produced which is printed with an image with ease with a high durabililty.

Therefore, when the card is printed, the ink image-receiving layer capable of temporarily holding an ejected sublimable dye ink is used as an intermediate medium, so that a clear image printed by the ink jet printing method can be directly transferred to the ink-fixing layer, that is, to the surface of the card. This makes it possible to efficiently form a clear image, and further protect the image by the ink-fixing layer without particularly applying pressure thereto, which enhances the rub resistance of the printed surface.

It should be noted that in the step of heating the card by the heating source, it is preferable to apply heat to the card in a non-contacting fashion. Further, it is preferred that the ink image-receiving layer is formed to be slightly larger than the ink-fixing layer. This makes it possible to properly carry out whole surface or edge-to-edge printing of the card, in the step of printing an image on the card, and also makes it easy to peel off the ink image-receiving layer, in the step of peeling the ink image-receiving layer off the card.

Preferably, the ink-fixing layer and the ink image-receiving layer are formed on each of a front surface and a back surface of the card, and the step of printing includes a first printing step of printing an image on one of the front surface and the back surface of the card while feeding the card, an inverting step of inverting the printed card upside down, and a second printing step of printing an image on another of the front surface and the back surface of the card while feeding the inverted card, and the step of heating includes heating the front surface and the back surface of the card simultaneously by the heating source, the step of peeling includes peeling the ink image-receiving layer off the each of the front surface and the back surface of the card.

According to this preferred embodiment, the card used by the method has the same laminate structure on both of the front surface and back surface thereof, which is formed by laminating the layers in the order of the ink-fixing layer and the ink image-receiving layer on the opposite sides of the substrate layer, such that doubled-sided printing by the ink jet printing method can be effected. In the doubled-sided printing, after an image is printed on an ink image-receiving layer of one surface of the card, the card is inverted upside down to print an image on an ink image-receiving layer of the other surface of the card. The card in this inverted position is sent to the heating source and heated thereby, similarly to the above, whereby the ink is fixed in each ink-fixing layer to form a respective image. By peeling off the ink image-receiving layers to expose the respective ink-fixing layers, it is possible to provide a card having images printed on both surfaces thereof.

This makes it possible to properly perform double-sided printing on a card, and efficiently form images on both surfaces of the card to shorten the whole processing time, since the heat treatment is carried out after printing the images on both sides of the card at a time. In this case, it is preferred that the same ink jet printing apparatus is employed in the first printing step and the second printing step. Further, the peeling of the ink image-receiving layer off the each of the front surface and the back surface of the card may be effected by simultaneously peeling off the ink image-receiving layers on both sides.

Preferably, a fluorine film layer is laminated between the ink-fixing layer and the ink image-receiving layer.

According to this preferred embodiment, after the heat treatment of the card, the ink droplets held in the ink image-receiving layer(s) pass through the fluorine film layer to be diffused and fixed in the ink-fixing layer(s). Further, after the ink image-receiving layer(s) is/are peeled off, the card has fluorine film layer(s) as topmost layer(s) thereof for protecting an image or images fixed in the ink-fixing layer (s). Thus, the image(s) is/are protected by the fluorine film layer(s) similarly to laminating films, whereby the surfaces of the card are made more excellent in weather resistance, light resistance, heat resistance, rub or abrasion resistance, and chemical resistance due to characteristics of the fluorine film layer(s), and assume a high gloss.

Preferably, the ink image-receiving layer is formed of a material which is made easily peelable by application of heat.

According to this preferred embodiment, the ink image-receiving layers are made easily peelable by the step of heating the card. As a result, it becomes possible to peel the ink image-receiving layers off the card very easily. On the other hand, the ink image-receiving layers cannot be peeled off easily before heat treatment, which prevents degradation of ease of handling of the card.

Preferably, the step of heating includes causing the card to pass by the heating source being driven for heating, at a constant speed.

According to this preferred embodiment, since the card is conveyed to pass by the heating source at a constant speed, it is possible to carry out feeding and heating of the card simultaneously and further the whole surface of the card can be heated uniformly. This makes it possible to prevent degradation of quality of print images due to unevenness of heating.

Preferably, the heating source is formed by a halogen lamp.

According to this preferred embodiment, the heating source implemented by a halogen lamp is quickly activated, and hence the time required for the heating process can be shortened. On the other hand, since the halogen lamp is a light source with short wavelengths, heat transmission to the substrate layer of the card can be suppressed. As a result, the surface(s) of the card with the ink image-receiving layer can be properly heated.

To attain the above object, according to a second aspect of the invention, there is provided a method of forming an image on a card having a substrate layer, and an ink-fixing layer laminated on a surface of the substrate layer, comprising the steps of:

printing an image on a transfer sheet by an ink jet printing method by using a sublimable dye ink while unrolling and feeding a roll of the transfer sheet, the transfer sheet having a substrate layer, and an ink image-receiving layer laminated on a surface of the substrate layer, whereby the sublimable dye ink is caused to be held by the ink image-receiving layer;

affixing the transfer sheet to the card by pressure while applying heat thereto, with an image-formed portion of the transfer sheet and the ink-fixing layer of the card being positioned and overlaid upon each other, thereby causing diffusion of the sublimable dye ink held in the ink image-receiving layer in the ink-fixing layer and color development to form an image; and peeling the transfer sheet off the card by taking up the transfer sheet into a roll.

According to this method, a transfer sheet having an ink image-receiving layer formed thereon is employed to form a print image on the card. When an image is directly printed on the transfer sheet by the ink jet printing method by using a sublimable dye ink, ink droplets of the sublimable dye ink are impregnated into the ink image-receiving layer and held therein. Then, a portion formed with the image in the form of the ink droplets is positioned on the card, and the transfer sheet is affixed to the card by pressing the transfer sheet onto the card (contact bonding) in a state of the sheet and card overlaid upon each other while applying heat thereto, whereupon from the portion formed with the image, particles of ink at a molecular level are thermally transferred or migrated deep into the ink-fixing layer so as to be evaporated and diffused, causing color development. By subsequently taking up the transfer sheet into a roll to thereby separate the sheet from the card, the image is formed on the card.

Therefore, when the card is printed, the transfer sheet having the ink image-receiving layer capable of temporarily holding the sublimable dye ink is used as an intermediate, so that a clear image printed by the ink jet printing method can be directly transferred to the ink-fixing layer, that is, to the surface of the card. This makes it possible to efficiently form a clear image, and further protect the image by the ink-fixing layer, which enhances the rub resistance of the printed surface.

Preferably, the step of printing includes printing a mirror image on the transfer sheet such that an image transferred therefrom onto the card forms a normal image.

According to this preferred embodiment, an image transferred onto a card is formed as a normal image.

Preferably, a fluorine film layer is laminated on a surface of the ink-fixing layer of the card.

According to this preferred embodiment, when the transfer sheet is affixed to the card by pressure while applying heat thereto, the ink droplets held in the transfer sheet pass through the fluorine film layer to be diffused and fixed in the ink-fixing layer. The card having the fluorine film layer as the topmost layer thereof protects the image fixed in the ink-fixing layer. Thus, the image is protected by the fluorine film layer similar to a laminating film, whereby the surface of the card is made more excellent in weather resistance, light resistance, heat resistance, rub or abrasion resistance, and chemical resistance due to characteristics of the fluorine film layer, and assume a high gloss.

Preferably, the step of affixing the transfer sheet to the card by pressure while applying heat thereto includes sandwiching the transfer sheet and the card overlaid upon each other between a pair of rollers, and advancing the transfer sheet and the card simultaneously at a constant speed in accordance with rotation of the rollers, at least one of the rollers toward the transfer sheet being a heating roller.

According to this preferred embodiment, a pair of rollers can affix the transfer sheet and the card to each other by applying pressure and heat thereto, while advancing them at a constant speed. In this case, the card is brought into rolling contact with the pair of rollers in a state in line contact therewith along the width of the card (in a direction orthogonal to the direction of feed of the card). This makes it possible to uniformly heat the whole surface of the card and press the card to the transfer sheet stably and uniformly. Consequently, it is possible to prevent degradation of quality of print images due to unevenness of applied heat and pressure. It should be noted that the rollers may be formed by metal rollers formed e.g. of stainless or the like having a predetermined surface smoothness, but more preferably, they are formed by rubber rollers with heat resistance.

Preferably, the step of affixing the transfer sheet to the card by pressure while applying heat thereto includes hot-pressing the image-formed portion of the transfer sheet and the card which are overlaid upon each other.

According to this preferred embodiment, the card has the whole area of its surface uniformly heated and pressed by a hot-pressing method in a state brought into surface contact with the transfer sheet. This makes it possible to ensure intimate contact between the card and the transfer sheet, thereby making it possible to produce an image of high quality. Further, it is possible to heat the card with efficiency.

To attain the above object, according to a third aspect of the invention, there is provided an apparatus for forming an image on a card, comprising:

conveyor means for conveying a card along a transport passage, the card having a substrate layer, an ink-fixing layer laminated on a surface of the substrate layer, and an ink image-receiving layer peelably laminated on a surface of the ink-fixing layer;

printing means arranged to face the transport passage, for printing an image on the card in synchronism with feed of the card by an ink jet printing method by using a sublimable dye ink to thereby cause the sublimable dye ink to be held by the ink image-receiving layer;

heating means arranged to face the transport passage, for applying heat treatment to the printed card to thereby cause diffusion of the sublimable dye ink held in the ink image-receiving layer in the ink-fixing layer to form an image; and a single casing for accommodating the conveyor means, the printing means, and the heating means.

According to this image forming apparatus, as described above, the ink droplets ejected for printing by the printing means and held in the ink image-receiving layer are thermally treated by the heating means, whereby migration particles of ink at a molecular level are evaporated and diffused deep into the ink-fixing layer, causing color development to form an image. In this case, the printing means and the heating means which are arranged to face the transport passage are accommodated in the single casing together with the conveyor means. Accordingly, these means accommodated in the case are capable of sequentially performing their operations to thereby directly transfer a clear image printed by the ink jet printing method to a surface of the card. This makes it possible to form a clear image on the card with efficiency. Further, it is possible to protect the image without particularly applying pressure thereto, which enhances rub resistance of the printed surface.

It should be noted that after the heat treatment of the card, the ink image-receiving layer is peeled off the card to cause the ink-fixing layer to be exposed. Thus, a card can be produced which is printed with an image with ease and a high durability. Further, it is preferable to form the ink image-receiving layer slightly larger than the ink-fixing layer. This enables the printing means to properly carry out whole surface printing of the card, and allows the ink image-receiving layer to be easily peeled off thereafter.

Preferably, a fluorine film layer is laminated between the ink-fixing layer and the ink image-receiving layer.

According to this preferred embodiment, when the ink image-receiving layer has been peeled off after the heat treatment, the card has the fluorine film layer as the topmost layer for protecting the image fixed in the ink-fixing layer thereof. This provides the image with protection by the fluorine film layer having the characteristics described above.

Preferably, the ink image-receiving layer is formed of a material which is made easily peelable by application of heat.

According to this preferred embodiment, the ink image-receiving layer is made easily peelable by heat treatment by the heating means, and it is easy to peel the ink image-receiving layer off the card.

Preferably, the apparatus further includes card supply means for storing a plurality of the cards in a stacked fashion and supplying the cards one by one to the conveyor means.

According to this preferred embodiment, it is possible to properly feed the cards to the conveyor means one by one while properly controlling the cards, and successively form images on a plurality of cards.

Preferably, the conveyor means includes printer-block conveyor means arranged in a manner associated with the printing means, heater-block conveyor means arranged in a manner associated with the heating means, and transfer means for transferring the card from the printer-block conveyor means to the heater-block conveyor means.

According to this preferred embodiment, the cards are brought to the printing means and the heating means by individual conveyor means, i.e. the printer-block conveyor means and the heater-block conveyor means, and passed or transferred by the transfer means from the printer-block conveyor means to the heater-block conveyor means. This makes it possible to control the feed of the cards individually in a manner associated with the printing means and the heating means, whereby cards can be conveyed in respective fashions suitable for printing and heating.

Preferably, the printer-block conveyor means includes a suction table for sucking and holding the card on a surface thereof by suction air, and a printer-block conveyor belt mechanism for conveying the card via the suction table.

According to this preferred embodiment, the card is transferred in accordance with the movement of the suction table in a state sucked and held horizontally on the suction table. Therefore, the card can be sent along the transport passage properly in a stable manner.

Preferably, the card has an identical laminate structure on both of a front surface and a back surface of the substrate layer, and the printer-block conveyor means is capable of conveying the card in both of a forward direction and a reverse direction, and includes inverting means for inverting the card upside down, the inverting means being arranged either on a proximal end side or on a distal end side of the printer-block conveyor means in a direction of feed of the card in a manner facing the transport passage.

According to this preferred embodiment, after one of the front surface and back surface of the card is printed, the card can be inverted upside down by the inverting means, and sent again by the printer-block conveyor means to print the other of the front surface and back surface of the card.

Preferably, the inverting means includes a catcher capable of receiving the card from the printer-block conveyor means and passing the card to the printer-block conveyor means, an inverting mechanism for inverting the card upside down via the catcher, and a sender roller for sending the card from the catcher.

According to this preferred embodiment, the card is temporarily held by the catcher, inverted by the catcher in a state held thereby, and sent from the catcher by the sender roller. Thus, the catcher is capable of performing reception and passing of the card between the same and the printer-block conveyor means, including inversion of the card.

Preferably, the inverting means also serves as the transfer means, and the sender roller is capable of rotating in both of normal and reverse directions, the catcher being arranged between the printer-block conveyor means and the heater-block conveyor means on the transport passage, and capable of cooperating with the sender roller to send the card in an inverted position to the heater-block conveyor means.

According to this preferred embodiment, the inverting means arranged on a distal end side of the printer-block conveyor means in the direction of transfer of the card also serves as the transfer means, and hence it is possible to simplify the inner construction of the apparatus. Further, when used as the transfer means, the inverting means can send the card to the heater-block conveyor means after restoring the original position of the card before printing. It should be noted that the catcher is preferably configured such that it can weakly hold or retain the lateral ends of the card, so as to prevent the card from falling off.

Preferably, the transfer means includes a catcher arranged on the transport passage between the printer-block conveyor means and the heater-block conveyor means such that the catcher is capable of receiving and passing the card, and a sender roller for sending the card from the catcher to the heater-block conveyor means.

According to this preferred embodiment, the card is passed to the heater-block conveyor means via the catcher cooperating with the sender roller. This enables the printer-block conveyor means and the heater-block conveyor means to properly carry out the feed of the card individually and separately in a state in which the card feeding operation is discontinued between the two conveyor means, and at the same time smoothly transfer the card from the printer-block conveyor means to the heater-block conveyor means.

Preferably, the apparatus further includes control means for controlling the heating means and the heater-block conveyor means, and the control means causes the heater-block conveyor means to convey the card such that the card passes by the heating means being driven for heating, at a constant speed.

According to this preferred embodiment, the card is conveyed at a constant speed in a state brought close to the heating means. Therefore, it is possible to feed and heat the card simultaneously as well as effect uniform heating of the whole surface of the card, thereby preventing degradation of quality of print images due to unevenness of heating.

Preferably, the control means is capable of changing a speed at which the card is conveyed.

According to this preferred embodiment, assuming that the heating temperature is constant, the amount of heat applied can be controlled by changing the speed at which the card is conveyed. This makes it possible to properly heat the card according to the type thereof dependent on the difference in thermal conductivity, or the like.

Preferably, the heating means is formed by a halogen lamp.

According to this preferred embodiment, the heating source implemented by a halogen lamp can be quickly activated, and hence processing time of the image forming process can be shortened. On the other hand, since the halogen lamp is a light source with short wavelengths, heat transmission to the substrate layer of the card can be suppressed. As a result, the surface(s) of the card with the ink image-receiving layer can be properly heated.

Preferably, the heating means is formed by a pair of halogen lamps arranged on opposite sides of the transport passage in a manner parallel and opposed to each other.

According to this preferred embodiment, the card subjected to doubled-sided printing can be thermally treated simultaneously under the same heating conditions.

Preferably, the heater-block conveyor means includes transport guides arranged along the transport passage for guiding the card while supporting the card by left and right side ends of the card, and a pushing mechanism for pushing the card guided by the transport guides, from behind.

According to this preferred embodiment, the card is carried forward while being supported on left-side end and right-side end faces thereof which are not printing surfaces. This makes it possible to send the card with the whole printing surface thereof facing outward (toward a heater device), thereby producing a card printed with an image of high quality and free of unevenness of heating. It should be noted that the transport guides are preferably constructed by a plurality of rotatably free rollers.

Preferably, the pushing mechanism is formed by a heater-block conveyor belt mechanism having pushing pawls formed on a surface thereof.

According to this preferred embodiment, the card has one of the pushing pawls brought into abutment with a trailing edge portion thereof, and at the same time is carried forward in accordance with belt conveyance of the pushing pawls. Therefore, the card can be transferred smoothly and suitably by the simple construction of the pushing pawls in a manner pushed from behind.

Preferably, the heating means is formed by a pair of halogen lamps arranged on opposite sides of the transport passage in a manner parallel and opposite to each other, and the heater-block conveyor belt mechanism having a conveyor belt stretched for revolving around one of the halogen lamps.

According to this preferred embodiment, it possible to increase the freedom of suitable arrangement of the halogen lamps. It should be noted that the conveyor belt is formed by a heat resistant silicone.

Preferably, the conveyor belt of the heater-block conveyor belt mechanism is stretched such that the conveyor belt faces a magnetic encoder portion of the card carried thereon.

According to this preferred embodiment, the card is transferred with its magnetic encoder portion facing the conveyor belt. This makes it possible to arrange the heater-block conveyor belt at a location opposed to the path of a portion of the card not requiring heat irradiation for fixing and forming an image. It should be noted that the ink image-receiving layer of the card may be configured to be uniformly laminated on the surface of the card including the magnetic encoder portion thereof, or alternatively, the same may be configured to be partially laminated on the surface of the card except the magnetic encoder portion thereof. In the latter case, since the conveyor belt blocks heat irradiation to the magnetic encoder portion of the card, it is possible to prevent thermal influence of heating against the magnetic encoder portion.

To attain the above object, according to a third aspect of the invention, there is provided another apparatus for forming an image on a card, comprising:

sheet feed means for feeding a transfer sheet along a traveling passage, the transfer sheet having a substrate layer, and an ink image-receiving layer laminated on a surface of the ink image-receiving layer;

printing means arranged to face the traveling passage, for printing an image on the transfer sheet in synchronism with feed of the transfer sheet by an ink jet printing method by using a sublimable dye ink;

card conveyor means for conveying a card along a transport passage, the card having a substrate layer, and an ink-fixing layer laminated on a surface of the substrate layer; and thermal pressing means arranged to face a confluent portion of the traveling passage and the transport passage, for affixing the transfer sheet to the card by pressure while applying heat thereto, with an image-formed portion of the transfer sheet and the ink-fixing layer of the card being positioned and overlaid upon each other, thereby causing diffusion of the sublimable dye ink held in the ink image-receiving layer in the ink-fixing layer and color development to form an image; and peeling means arranged at a location downstream of the thermal pressing means, for peeling the transfer sheet off the card; and a single casing for accommodating the sheet feed means, the printing means, the card conveyor means, the thermal pressing means, and the peeling means.

According to this image forming apparatus, a transfer sheet having an ink image-receiving layer formed thereon is employed to form a print image on a card. In this case, when an image is directly printed on the transfer sheet sent along the traveling passage by the ink jet printing method using the sublimable dye ink, ink droplets are impregnated into the ink image-receiving layer and held therein. Then, a portion formed with the image in the form of the ink droplets is positioned on the card, and the transfer sheet is affixed to the card by pressure in a state of the sheet and card overlaid upon each other while applying heat thereto, whereupon from the portion formed with the image, particles of ink at a molecular level are thermally transferred or migrated deep into the ink-fixing layer so as to be evaporated and diffused, causing color development. By subsequently taking up the transfer sheet into a roll to thereby separate the sheet from the card, the card having the image fixed in a surface thereof is provided.

In this case, the sheet feed means and other means are accommodated in a single casing, and a clear image can be formed in a surface of the card through a sequence of operations by these means in the casing. This makes it possible to efficiently form the clear image on the card.

It should be noted that it is preferable that the ink image-receiving layer is slightly larger than the ink-fixing layer. This enables the printing means to properly carry out whole surface printing on the card.

Preferably, the printing means prints a mirror image of the image on the transfer sheet such that an image transferred therefrom onto the card forms a normal image.

According to this preferred embodiment, an image transferred onto a card is formed as a normal image.

Preferably, a fluorine film layer is laminated on a surface of the ink-fixing layer of the card.

According to this preferred embodiment, when the transfer sheet is affixed to the card by pressure while applying heat to them, the ink droplets held in the transfer sheet pass through the fluorine film layer to be diffused and fixed in the ink-fixing layer. The card having the fluorine film layer as the topmost layer thereof protects the image fixed in the ink-fixing layer. Thus, the image comes to be protected by the fluorine film layer which provides a laminating film, and the surface of the card is made more excellent in weather resistance, light resistance, heat resistance, rub or abrasion resistance and chemical resistance due to characteristics of the fluorine film layer, and assume a high gloss.

Preferably, the apparatus further includes card supply means for storing a plurality of the cards in a stacked fashion and supplying the cards one by one to the card conveyor means.

According to this preferred embodiment, it is possible to properly feed the cards to the card conveyor means one by one while controlling the cards with ease, and bring a plurality of cards to the transfer sheet successively. It should be noted that the card supply means may be accommodated in the single casing.

Preferably, the sheet feed means includes a supply reel for unrolling a roll of the transfer sheet wound therearound, and a take-up reel for taking up the transfer sheet unrolled, and the transfer sheet is unrolled from the supply reel, sent along the traveling passage, peeled off the card, and then taken up by the take-up reel.

According to this preferred embodiment, it is possible to provide the transfer sheet in the form of a roll, thereby making it possible to carry out printing on the transfer sheet continuously. Therefore, unused and used transfer sheets can be managed easily. It should be noted that the take-up reel is used as a part of the peeling means.

Preferably, the traveling passage is formed by a cartridge casing, and the supply reel, the take-up reel, and the transfer sheet are accommodated in the cartridge casing to form a sheet cartridge.

According to this preferred embodiment, it becomes possible to facilitate handling of the apparatus, such as storage of the transfer sheet, and the like, when the apparatus is transported. Further, when a transfer sheet is used up, another transfer sheet can be provided easily by replacement of the sheet cartridge accommodating the transfer sheet.

Preferably, the thermal pressing means comprises a pair of rollers which sandwich the transfer sheet and the card overlaid upon each other therebetween, and advances the sheet and the card at a constant speed in accordance with rotation thereof, at least one of the rollers toward the transfer sheet being a heating roller.

According to this preferred embodiment, a pair of rollers can affix the transfer sheet and the card to each other by application of pressure and heat thereto, while advancing them at a constant speed. In this case, the card is brought into rolling contact with the pair of rollers in a state in line contact therewith along the width of the card (in a direction orthogonal to the direction of feed of the card). This makes it possible to uniformly heat the whole surface of the card and press the card to the transfer sheet stably and uniformly. Consequently, it is possible to prevent degradation of quality of print images due to unevenness of applied heat and pressure. It should be noted that the rollers may be formed by metal rollers formed e.g. of stainless or the like having a predetermined surface smoothness, but more preferably, they are formed by rubber rollers with heat resistance.

Preferably, the thermal pressing means is formed by a hot-pressing mechanism for sandwiching an image-formed portion of the transfer sheet and the card overlaid upon each other, and applying heat thereto.

According to this preferred embodiment, the card has the whole area of its surface uniformly heated and pressed by a hot-pressing method in a state brought into surface contact with the transfer sheet. This makes it possible to ensure intimate contact between the card and the transfer sheet, thereby making it possible to produce an image of high quality. Further, it is possible to heat the card with efficiency.

The above and other objects, features, and advantages of the invention will become more apparent from the following detailed description taken in conjunction with the accompanying drawings.

BRIEF DESCRIPTION OF THE DRAWINGS

FIGS. 5A to 5C are cross-sectional views schematically showing steps of forming an image on a card, in which:

FIG. 5A illustrates permeation of ink droplets of a printed image into the card;

FIG. 5B shows transfer of the ink droplets into a lower layer of the card, which is caused by heat treatment; and FIG. 5C illustrates peeling of an uppermost layer of the card after the heat treatment;

FIGS. 9A to 9D are cross-sectional views schematically showing steps of forming an image on a card according to the second embodiment, in which:

FIG. 9A illustrates a state of a transfer sheet printed with a image;

FIG. 9B illustrates a state of the transfer sheet overlaid onto a card;

FIG. 9C illustrates a state of the transfer sheet affixed to the card by pressing while applying heat thereto; and FIG. 9D illustrates peeling of the transfer sheet off the card.

DETAILED DESCRIPTION OF PREFERRED EMBODIMENTS

Figure 1:
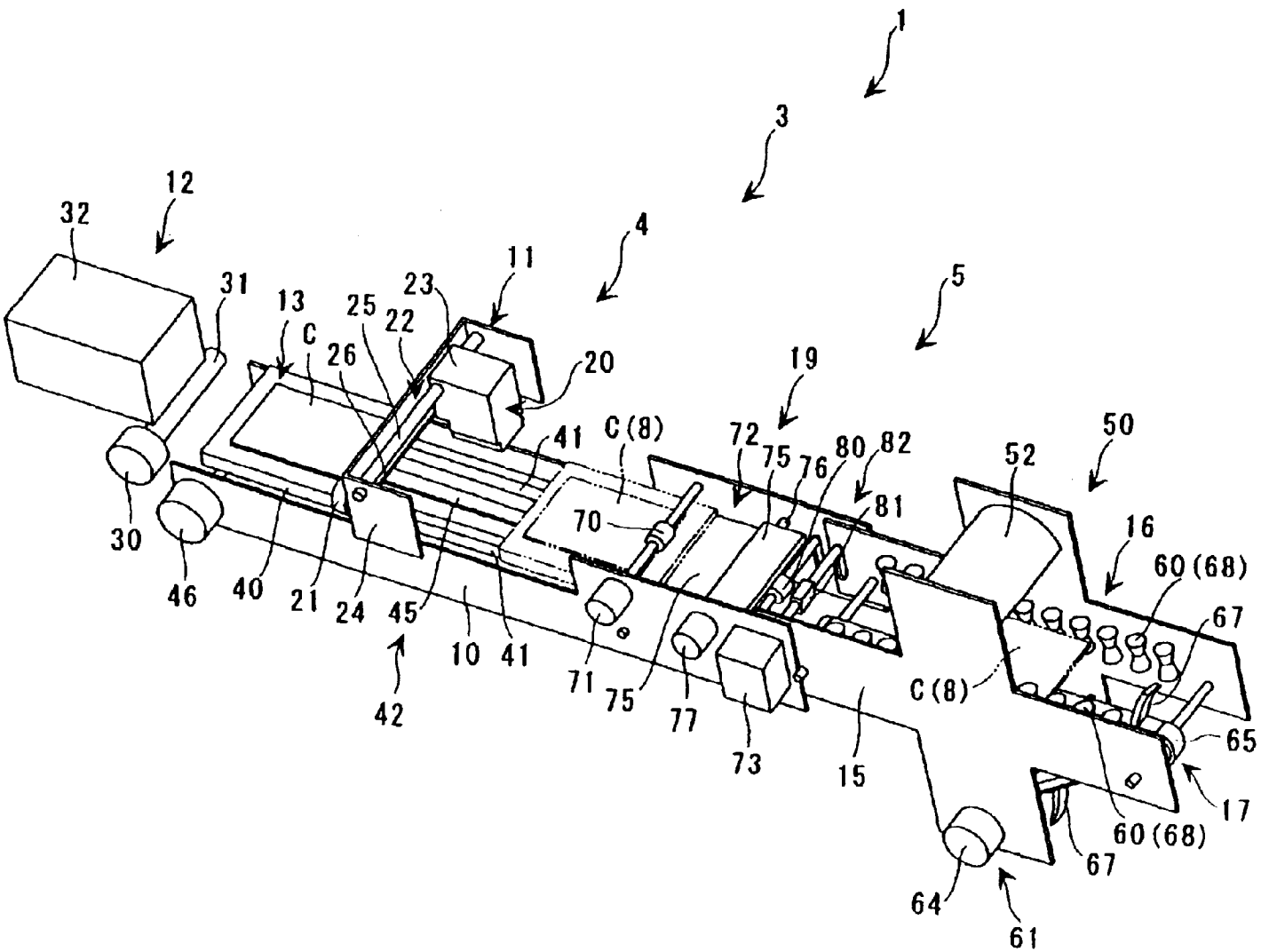
FIG. 1 is a perspective view showing the internal construction of an image forming apparatus for forming an image on a card, according to a first embodiment of the invention.
Figure 2:
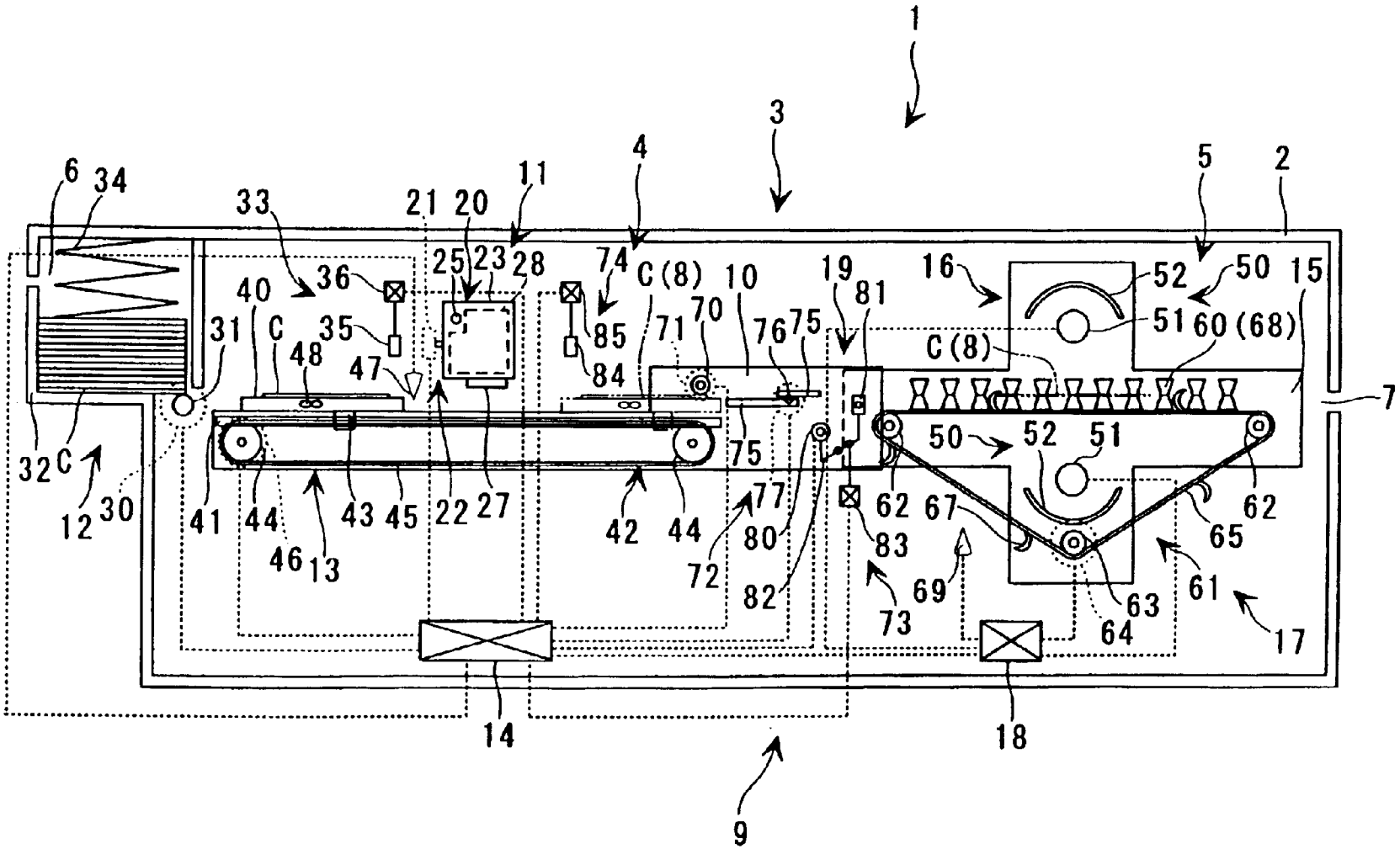
FIG. 2 is a cross-sectional view showing the internal construction of the image forming apparatus.
Figure 3:
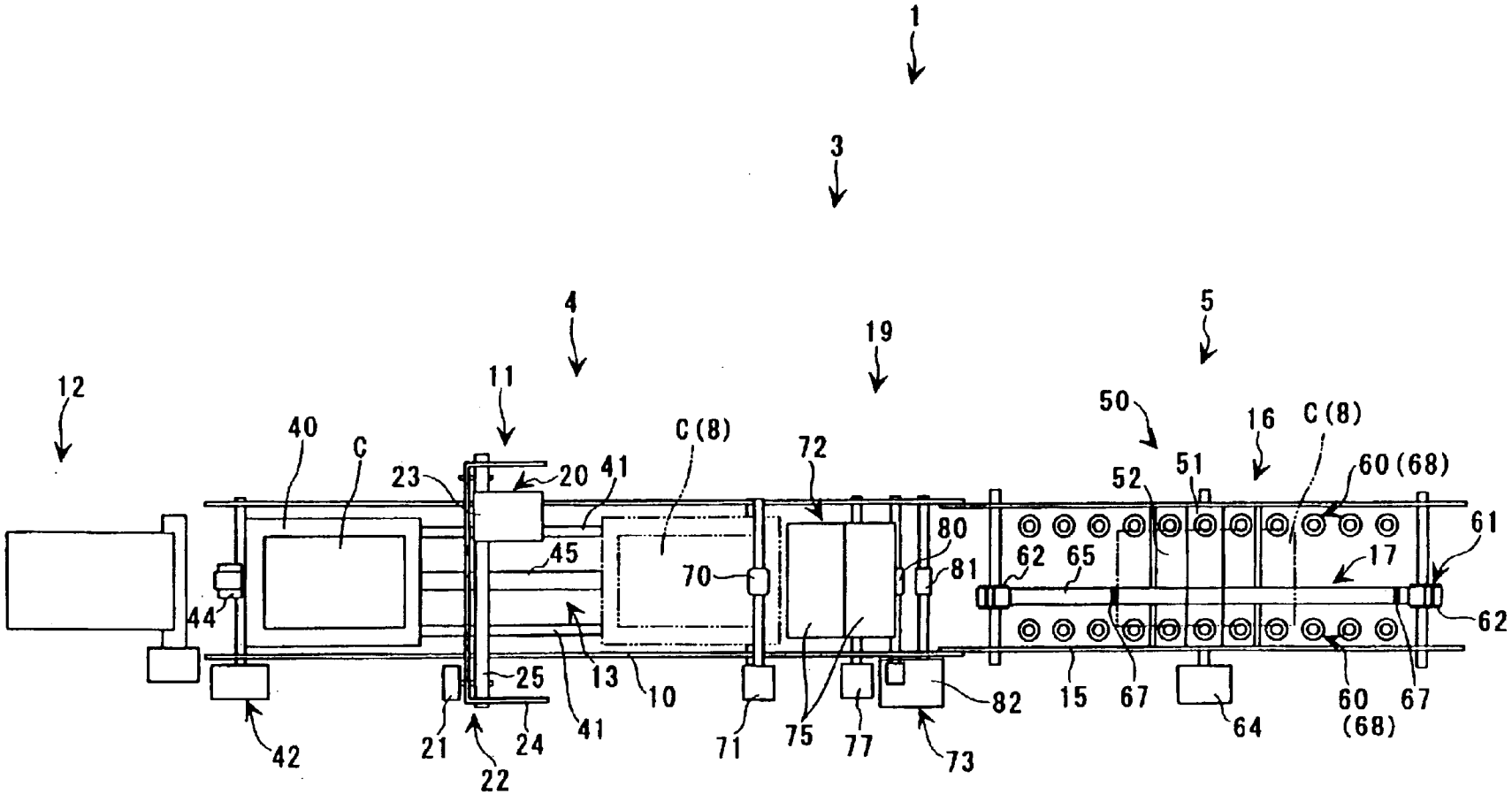
FIG. 3 is a plan view showing the internal construction of the image forming apparatus.

The invention will now be described in detail with reference to drawings showing embodiments thereof. FIG. 1 is a perspective view showing the internal construction of the image forming apparatus, FIG. 2 is a cross-sectional view of the image forming apparatus, and FIG. 3 is a plan view of the same. An image-forming apparatus to which are applied the method of forming a image and the apparatus therefor according to a first embodiment of the present invention performs printing of images, such as letters, figures, a background, and so forth, on a card (medium body), such as a cash card or a credit card having a predetermined thickness, by using a sublimable dye ink and the ink jet printing method, and then applies heat treatment to the printed card while feeding the same, to thereby form an image thereon. Further, this image forming apparatus is capable of forming images on both surfaces of the card.

As shown in these figures, the image-forming apparatus 1 has an apparatus body 3 including an outer shell formed by a box-shaped casing 2, a printer block 4 arranged at a location leftward of the central portion of the apparatus body 3, for printing on a card C, and a heater block 5 arranged at a location rightward of the same, for applying heat treatment to the printed card C. Further, the apparatus body 3 includes a controller 9 for controlling the printer block 4 and the heater block 5. In a printer block-side upper corner portion of the casing 2, there is formed a card supply port 6 via which cards C are introduced into the apparatus, while in an intermediate portion of a heater block-side end wall of the casing 2, there is formed a card exit 7 via which the card C is delivered out of the apparatus. Further, in the apparatus body 3, a transport passage 8 for conveying the card C extends horizontally and linearly in a manner communicating between the card supply port 6 and the card exit 7.

The printer block 4 is supported by left and right printer-block frames 10. The printer block 4 is comprised of a printer device 11 which carries out printing on the card C by a reciprocating head unit 20, a card feeder 12 which feeds cards C introduced via the card supply port 6, one by one, to the printer device 11, a printer-block conveyor device 13 which sucks the card C fed from the card feeder 12 and carries the card C along the transport passage 8 to the printer device 11, and a printer-side controller 14 which performs centralized control of the devices 11, 12, 13.

Each of the cards C sent one by one from the card feeder 12 is received by the printer-block conveyor device 13, passes by the head unit 20, followed by being sent to the heater block 5. While the card C is fed or advanced intermittently when passing under the head unit 20, the head unit carries out printing on the card C while reciprocating in a direction orthogonal to the card-feeding direction. More specifically, printing is performed by the ink jet method using the sublimable dye ink such that the feed of the card C and the reciprocating motion of the head unit 20 correspond to the main scanning and the sub scanning in printing technology, respectively.

The heater block 5 is supported by left and right heater-block frames 15. The heater block 5 is comprised of a heater device 16 which subjects the printed card C received from the printer block 4 to heat treatment, a heater-block conveyor device 17 which carries the card C received from the printer-block conveyor device 13 along the transport passage 8 to pass the card C through the heater device 16 and then delivers the same out of the casing 2 via the card exit 7, and a heater-side controller 18 which performs centralized control of the devices 16, 17. Each card C fed from the printer block 4 has both surfaces thereof subjected to heat treatment by the heater device 16 and has printed images fixed thereon, followed by being delivered out via the card exit 7.

Between the printer block 4 and the heater block 5, there is arranged an inversion/transfer device 19 on the transport passage 8, for properly transferring the card C from the printer-block conveyor device 13 to the heater-block conveyor device 17. The inversion/transfer device 19 is supported by the printer-block frames 10 or the heater-block frames 15. When the back surface of the card C is printed, the inversion/transfer device 19 inverts the card C upside down after receiving the card C from the printer-block conveyor device 13 and then transfers the same to the printer-block conveyor device 13 again. Further, when transferring the card C to the heater block 5, the inversion/transfer device 19 transfers the card C to the heater-block conveyor device 17 after inverting the card C, or alternatively without inverting the same.

The printer-side controller 14 and the heater-side controller 18 are formed by a unitary controller 9 including a CPU for carrying out various control operations, a ROM for storing control programs and control data for controlling the above-mentioned devices 10, 11, 12, 13, 16, 17, and the inversion/transfer device 19, a RAM used as work areas for carrying out control processes, and driving circuits for driving the devices and components of the image forming apparatus 1.

As described above, the controller 9 controls the printer block 4 and the heater block 5 such that they are operated separately and at the same time in a manner correlated with each other, to carry out printing of an image on the both surfaces of each card C fed to the printer block 4, and then apply heat treatment to the printed card C for fixing the images, followed by delivering the same out of the casing 2 via the card exit 7. Now, the card C will be described in detail prior to description of each component device of the image-forming apparatus 1.

Figure 4A:
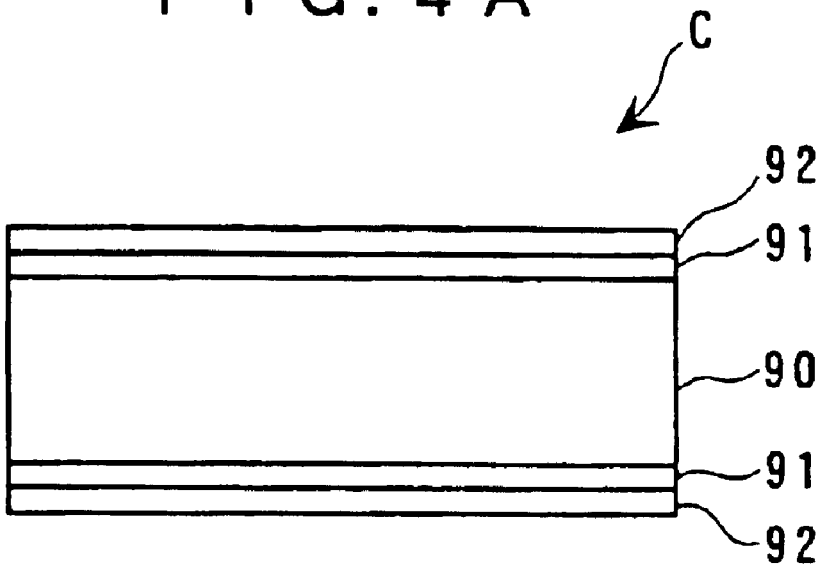
FIG. 4A is a cross-sectional view schematically showing the laminate structure of an inexpensive card.
Figure 4B:
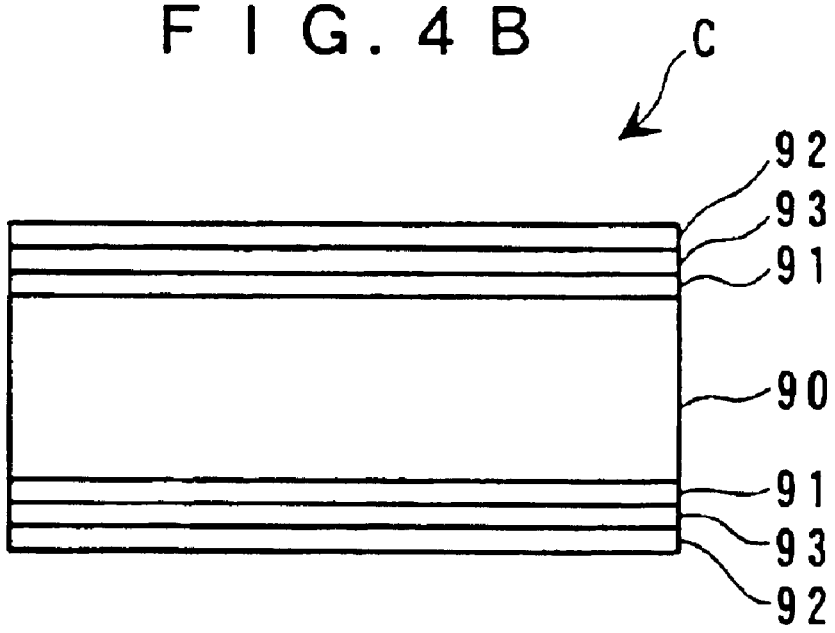
FIG. 4B is a cross-sectional view schematically showing the laminate structure of a high-grade card.

FIGS. 4A and 4B show laminate structures of two kinds of cards C. In the present embodiment, there are provided an inexpensive card shown in FIG. 4A and a high-grade card shown in FIG. 4B. Each of the two cards C is comprised of a substrate layer 90, ink-fixing layers 91 laminated on respective opposite surfaces of the substrate layer 90, and ink image-receiving layers 92 laminated on the respective opposite surfaces of the ink-fixing layers 91, and has a laminate structure symmetrical with respect to the substrate layer 90. In short, the cards C are each formed such that double-sided printing can be effected thereon. Further, in the card C of FIG. 4B, each of the ink-fixing layers 91 has a fluorine film layer 93 laminated between the ink-fixing layer 91 and the ink image-receiving layer 92, as a substitute for a laminating film.

The substrate layer 90 is formed of a plastic film formed e.g. of PVC (polyvinyl chloride) or PET (polyethylene terephthalate), or a synthetic paper so as to maintain the rigidity of the entire card C. Further, in general, the substrate layer 90 is basically formed of a white material. While the ink image-receiving layer 92 is capable of temporarily holding the sublimable dye ink directly ejected thereon for printing, it is formed of a hydrophilic resin material which is easy to peel off by heating. In short, the ink image-receiving layer 92 is made easy to peel off by heating although it is hard to peel off before heating. The ink-fixing layer 91 is formed e.g. of a transparent PET film and functions as a layer into which the sublimable dye ink finally permeates. It should be noted that the ink image-receiving layer 92 is formed by coating the resin material on the surface of each ink-fixing layer 91 in the form of a lamina.

Figure 5A:
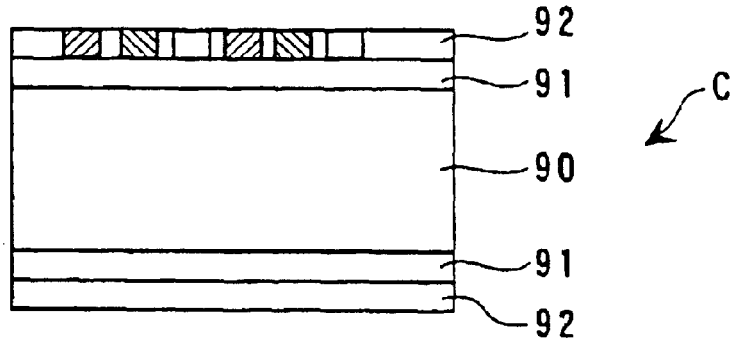
Figure 5B:
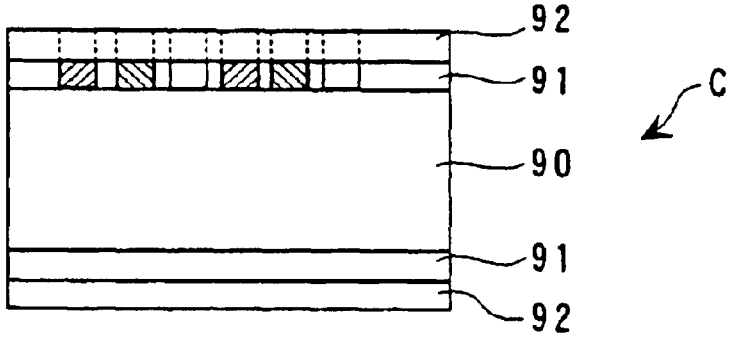
Figure 5C:
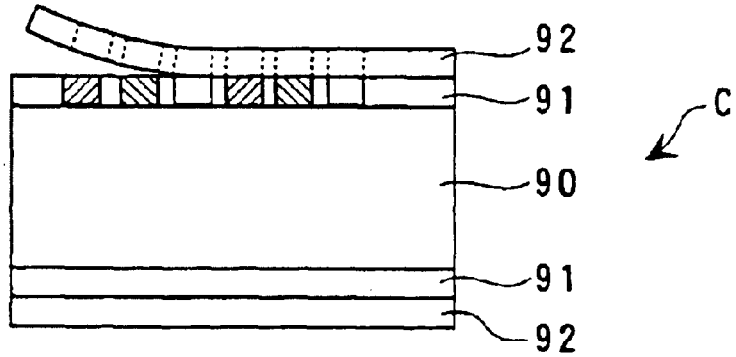

As shown in FIGS. 5A to 5C, when an image is printed on the card C by the ink jet printing method, ink droplets of the sublimable dye ink are impregnated into the ink image-receiving layer 92 and held therein. The ink droplets penetrate close to the boundary between the ink image-receiving layer 92 and the ink-fixing layer 91 thereunder. When the card C is heated in this state, the ink droplets further penetrate deep into the ink-fixing layer 91 as migration particles having sizes at a molecular level. In other words, the heating causes the evaporation/diffusion of the ink droplets held in the ink image-receiving layer 92 and color development in the ink-fixing layer 91, whereby the image is formed and fixed in the ink-fixing layer 91. Thereafter, the ink image-receiving layer 92 is removed to expose the ink-fixing layer 91, whereby the card C having the image fixed in the ink-fixing layer 91 is produced.

Similarly, when the FIG. 4B card 4C having the fluorine film layer 93 laminated thereon is used for printing, ink droplets are impregnated into the ink image-receiving layer 92 and held therein. When the card C is heated in this state, the ink droplets pass through the fluorine film layer 93 so as to be diffused and fixed in the ink-fixing layer 91. Then, when the ink image-receiving layer 92 is removed, the card C is produced which has the fluorine film layer 93 as an outermost surface layer thereof for protection of the image fixed in the ink-fixing layer 91. Thus, the card C having the image formed thereon becomes more excellent in weather resistance, light resistance, heat resistance, rub or abrasion resistance and chemical resistance due to characteristics of the fluorine film layer 93. Further, the fluorine film layer 93 gives a high gloss to the card C.

It should be noted that the ink image-receiving layer 92 is preferably formed of a material having a dark color (gray, for instance). This makes it possible to heat the whole surface of a card C uniformly in a heating process, thereby forming a high-quality print image without unevenness of printing. Further, if the ink image-receiving layer 92 on the front side of the card C and that on the back side thereof are formed of materials different in color, it is possible to make it easy to distinguish the front surface of the card C from the back surface thereof.

Although in the present embodiment, the card C having the ink-fixing layers 91 coated with the ink image-receiving layers 92 in advance is employed, this is not limitative, but the ink image-receiving layers 92 may be formed as separate members from the card C, that is, as ink image-receiving sheets which are affixed to the surfaces of the ink-fixing layers 91 to form the ink image-receiving layers 92 on the card C. In this case, it is preferable that each ink image-receiving sheet has a surface tackiness. Further, it is preferred that the ink image-receiving sheet is slightly larger than the substrate layer 90 (each ink-fixing layer 91) of the card C. This makes it possible to properly print on the card C in an edge-to-edge fashion (whole surface printing).

Moreover, the sublimable dye ink can be also fixed in the substrate layer 90, which is formed of PVC or the like, and therefore, the card C may be formed by the substrate layer 90 alone without providing the ink-fixing layers 91 as transparent layers.

Next, the components of the printer block 4 will be described in detail with reference to FIGS. 1 to 3. The printer device 11 is comprised of the head unit 20, a carriage motor 21 as a drive source, and a reciprocating mechanism 22 which receives torque from the carriage motor 21 to reciprocate the head unit 20. The carriage motor 21 is connected to the printer-side controller 14. The head unit 20 is comprised of an ink jet head 27 having a plurality of nozzles formed on an underside surface thereof, an ink cartridge 28 which supplies ink to the ink jet head 27, and a carriage 23 carrying the ink jet head 27 and the ink cartridge 28. The ink cartridge 28 contains sublimable dye inks of four colors, i.e. yellow, cyan, magenta, and black. The ink cartridge 28 may contain inks of six colors including two other colors, i.e. light cyan and light magenta, in addition to the above four.

The sublimable dye inks are each formed of a sublimable dye which undergoes sublimation by heat. As described above, each sublimable dye ink is impregnated into the ink image-receiving layer 92 and once held therein. Then, the sublimable dye ink is transferred into the ink-fixing layer 91 under the ink image-receiving layer 92 by heat applied in the heating process, and undergoes diffusion/evaporation and color development.

The reciprocating mechanism 22 includes a carriage guide shaft 25 having opposite ends thereof supported by left and right guide frames 24 and a timing belt 26 extending in parallel with the carriage guide shaft 25. The carriage 23 is supported by the carriage guide shaft 25 such that the carriage 23 can perform reciprocating motion. Further, the carriage 23 has a portion thereof fixed to the timing belt 26. When the carriage motor 21 drives the timing belt via a pulley to cause the same to travel in the normal and reverse directions, the carriage 23 performs reciprocating motion while being guided by the carriage guide shaft 25. During this reciprocating motion of the carriage 23, ink droplets are properly ejected from the ink jet head 27, whereby printing is performed on the card C.

The card feeder 12 is comprised of a feed motor 30 as a drive source, a feed roller 31 rotated by the feed motor 30, a card cassette 32 containing a plurality of cards C in a stacked fashion, and a first setting mechanism 33 for properly setting a card C on the printer-block conveyor device 13. The card cassette 32 is formed by projecting a rear side portion of the casing 2 outward, such that it has an inner plane shape generally similar to the plane shape of the card C. Further, the card cassette 32 has a predetermined depth which allows a plurality of cards C to be set in a stacked fashion. The upper part of the card cassette 32 is formed as a lid which faces toward the card supply port 6, and when the lid is closed, a spring 34 thereof urges a stack of cards C downward.

The feed roller 31 is arranged under a front portion of the card cassette 32 in a manner held in rolling contact with a forward portion of the underside surface of a lowermost one of the stacked cards C. The feed motor 30 is connected to the printer-side controller 14, for control of rotation of the feed roller 31. A front wall of the card cassette 32 extends downward to a location below which a lowermost card C alone is allowed to pass. The front wall blocks forward motion of cards C above the lowermost card C during feeding of the lowermost card C by the feed roller 31, whereby the cards C can be reliably sent forward one by one.

The first setting mechanism 33 is arranged at a location immediately above a suction table 40, referred to hereinafter, which has been moved to a proximal end side of the transport passage 8, and comprised of a first positioning plate 35 which can move vertically, and a first solenoid 36 as a drive source for causing the vertical motion of the first positioning plate 35(see FIG. 2). The first solenoid 36 is connected to the printer-side controller 14 and starts operating in synchronism with the feed roller 31. More specifically, when the feed motor 30 starts to be driven, the first solenoid 36 also starts to be energized, whereby the first positioning plate 35 starts to move downward simultaneously with the start of rotation of the feed roller 31.

The extreme forward end of the card C having been flicked from the feed roller 31 is brought into abutment with the first positioning plate 35 moved to its lowermost position by the first solenoid 36, whereby the card C is positioned and set on the suction table 40. In this case, the suction table 40 has already started sucking operation, so that the card C brought into abutment with the first positioning plate 35 is instantly attracted onto the surface of the suction table 40.

The printer-block conveyor device 13 is comprised of the square suction table 40 for sucking and holding the card C, a pair of left and right guide rails 41, 41 extending along the transport passage 8, and a printer-block conveyor belt mechanism 42 for moving the suction table 40 along the guide rails 41, 41. The suction table 40 has the upper surface thereof formed with numerous suction holes, not specifically shown, and at the same time incorporates a suction fan 48 communicating with the suction holes. The suction table 40 holds the card C horizontally on the upper surface thereof by sucking or attracting the same thereto by the cooperation of the suction fan 48 and the suction holes thereof. The two guide rails 41, 41, which are supported by the left and right printer-block frames 10, respectively, support the suction table 40 thereon and guide the same for stable movement along the transport passage 8.

The printer-block conveyor belt mechanism 42 is comprised of a pair of table-carrying pulleys 44, 44 arranged at respective locations upstream and downstream of (proximal end side and distal end side with respect to) the printer device 11 in a manner opposed to each other, a table-carrying belt 45 stretched between the two table-carrying pulleys 44, 44, and a table-driving motor 46 for driving the proximal end-side table-carrying pulley 44. The table-carrying belt 45 extends between and in parallel with the pair of guide rails 41, 41. The suction table 40 is fixed to a portion of the table-carrying belt 45 via a holding piece 43.

The table-driving motor 46 is connected to the printer-side controller 14. As the table-driving motor 46 rotates, the proximal end-side table-carrying pulley 44 rotates to cause the table-carrying belt 45 to travel in the normal or reverse direction. Thus, the suction table 40 can reciprocate along the transport passage 8 while being supported and guided by the pair of guide rails 41, 41 in a laterally well-balanced fashion.

As shown in FIG. 2, the card C sucked and held horizontally by the suction table 40 moves to the printer device 11 with the movement of the suction table 40. When the suction table 40 reaches a predetermined position before the printer device 11, the forward end of the suction table 40 is detected by a table-detecting sensor 47 arranged above the transport passage 8, and the printer-side controller 14 drives the head unit 20 and the reciprocating mechanism 22. As a result, the head unit 20 reciprocates, and the suction table 40 is advanced intermittently, whereby an image is printed on the card C. After completion of the printing on the card C, the suction table 40 travels forward along the transport passage 8 with the card C carried thereon, until the card C is brought to the inversion/transfer device 19.

The inversion/transfer device 19 is arranged at a distal end portion (on the front end side) of the transport passage 8 of the printer-block conveyor device 13. The inversion/transfer device 19 is comprised of a carrier roller 70 arranged above the suction table 40, a carrier motor 71 for driving the carrier roller 70, a catcher 72 which is arranged at a location forward of the carrier roller 70 and capable of receiving and passing the card C transferred by the carrier roller 70 in rolling contact with the card C, and a retracting mechanism 73 which is arranged at a location forward of the catcher 72 and includes a sender roller 80 in rolling contact with an underside surface of the card C in the catcher 72. The carrier roller 70 is caused to perform normal or reverse rotation by the normal or reverse rotation of the carrier motor 71 to be brought into rolling contact with an upper surface of the card C. More specifically, the carrier roller 70 rotates in the normal direction to thereby feed the card C from the suction table 40 to the catcher 72, and rotates in the reverse direction to thereby set the card C sent from the catcher 72 on the suction table 40.

Immediately above the suction table 40 having moved to the forward end of the transport passage 8, there is arranged a second setting mechanism 74 corresponding to the first setting mechanism 33. The second setting mechanism 74 is comprised of a second positioning plate 84, and a second solenoid 85. The second solenoid 85 is driven in synchronism with rotation of the carrier roller 70. More specifically, when the carrier motor 71 starts to be driven, the second solenoid 85 starts to be energized, and the second positioning plate 84 starts to be moved downward simultaneously with the start of rotation of the carrier roller 70. Accordingly, the rear end of the card C is brought into abutment with the second positioning plate 84 and positioned thereat, followed by being sucked by the suction table 40 and set on the surface of the same.

The catcher 72 is comprised of a pair of rotating operation plates 75, 75 arranged in a manner opposed to each other via the transport passage 8. The pair of rotating operation plates 75, 75 each have a width corresponding to the width of the card C, and face each other with a card-holding gap as wide as the thickness of the card C therebetween at their root portions toward the center of rotation of thereof. More specifically, the upper rotating operation plate 75 extends toward the heater block side, whereas the lower rotating operation plate 75 extends toward the printer block side. Below the upper rotating operation plate 75, the sender roller 80 is arranged in a manner opposed to the same. The card C is permitted not only to pass through the card-holding gap between the pair of rotating operation plates 75, 75 but also to be held in the card-holding gap therebetween.

Further, the pair of rotating operation plates 75, 75 are rotatably supported on the printer-block frames 10 by an axle pin 76 to which a rotating motor 77 is connected. When the rotating motor 77 is driven for rotation, the rotating operation plates 75, 75 are rotated through 180 degrees about the axis of the axle pin 76 to invert the card C held in the catcher 72 upside down. More specifically, the rotating operation plates 75, 75 are constructed such that they can perform reciprocal rotation through 180 degrees to thereby invert the card C to cause the back surface of the card C to be exposed to open space of the transport passage 8. It should be noted that the surfaces of portions of the rotating operation plates 75, 75 forming the card-holding gap therebetween have felt or the like, not shown, provided thereon such that these portions can hold or preserve the side ends of the card C weakly to prevent the card C from falling out of the gap.

The retracting mechanism 73 includes the sender roller 80, an abutting plate 81 arranged at a location forward of the sender roller 80, a link mechanism 82 for connecting the sender roller 80 and the abutting plate 81 to each other, and a retracting solenoid 83 as a drive source for causing the sender roller 80 and the abutting plate 81 to be moved upward and downward by the link mechanism 82. The sender roller 80 is configured such that it can be driven for normal and reverse rotations by rotation of a sender motor, not shown, and brought into rolling contact with the underside surface of the card C held in the catcher 72. More specifically, the sender roller 80 cooperates with the catcher 72 to send the card C to the heater block 5, by normal rotation thereof, or alternatively send the card C to the printer block 4 (carrier roller 70) by reverse rotation thereof.

The abutting plate 81 is arranged such that it can be brought into abutment with the front end portion of the card C sent from the catcher 72, as required, to serve as a stopper. The link mechanism 82 supports the sender roller 80 and the abutting plate 81 at its opposite ends to cause the sender roller 80 and the abutting plate 81 to move upward and downward such that they perform sea-sawing motion. The retracting solenoid 83 is connected to the printer-side controller 14. When the retracting solenoid 83 is energized, the sender roller 80 and the abutting plate 81 are alternately moved upward and downward by the link mechanism 82. More specifically, the sender roller 80 and the abutting plate 81 are controlled by the printer-side controller 14 such that they are alternately moved upward and downward as required along slots in the printer-block frames 10 or the heater-block frames 15.

Now, the flow of conveyance of the card C from the inversion/transfer device 19 to the heater-block conveyor device 17, which is required when doubled-sided printing is carried out on the card C, will be described hereinafter. After the front surface of the card has been printed, the card C is sent from the suction table 40 into the catcher 72 in a flicked manner by the carrier roller 70 rotating in the normal direction. The card C sent into the catcher 72 is brought into abutment with the abutting plate 81 at a forward end position for stopping the card C, and held in the catcher 72. In this state, when the catcher 72 is rotated, the card C is inverted and brought to the transport passage 8 again. At this time, the sender roller 80 is moved upward, and brought into abutment with the underside surface (the above-mentioned upper surface) of the card C to send the card C into the printer block side. The card C sent into the printer block 4 is further transferred to the printer-block conveyor device 13 such that it is caught between the carrier roller 70 and the suction table 40. Then, the card C is brought into abutment with the second positioning plate 84 and sucked to be held on the suction table 40.

After that, the card C held by the suction table 40 once passes under the head unit 20 to return to the proximal end of the transport passage 8 in the printer block 4, and then the printing operation for printing on the back surface of the card C is started. After an image is printed on the back surface of the card C by the printer device 11, the card C having the both surfaces thereof printed with the images is brought to the inversion/transfer device 19 again, and sent to the heater block 5 by the carrier roller 70 and the sender roller 80 in a manner passing through the catcher 32.

It should be noted that, as described in detail hereinafter, in the heater block 5, the card C is transferred with its magnetic encoder portion-side down. Therefore, when the card C having the both surfaces printed with images is brought to the inversion/transfer device 19 with its magnetic encoder portion-side up, the card C is inverted again upside down, and then sent to the heater block 5. More specifically, the image forming apparatus 1 is configured such that a sensor, not shown, which is capable of detecting the front surface or back surface of the card C (i.e. the presence or absence of the magnetic encoder portion) is arranged at a location forward of the feed roller 31 in the direction of transfer of the card C, and the card C is transferred to the heater block 5 based on a result of detection by the sensor. Further, the suction fan 48 of the suction table 40 may continue to be driven without stopping the sucking operation thereof.

Next, the components of the heater block 5 will be described in detail. The heater device 16 is comprised of a pair of irradiation units 50, 50 which face the card C being fed, in a non-contacting fashion. The pair of irradiation units 50, 50 are arranged on opposite sides of the transport passage 8 in a manner parallel and vertically opposed to each other with a predetermined space therebetween. Each of the irradiation units 50, 50 is comprised of a halogen lamp 51 as a heat source and a light condensing plate 52 arcuate in cross section. The light condensing plate 52 reflects and collects lights from the halogen lamps 51, 51. In short, the card C is fed in a state spaced from the pair of irradiation units 50, 50 by a fixed distance.

Each of the halogen lamps 51 extends in the direction of the width of the apparatus 1 across the card C (i.e. the direction orthogonal to the conveying direction) and has left and right ends thereof supported by the respective heater-block frames 15. The halogen lamps 51 are each connected to the heater-side controller 18, which controls the heating temperature of the halogen lamps 51. It should be noted that the amount of heat applied to the card C can be controlled by two factors, i.e. the heating temperature of the halogen lamps 51 and the conveying speed at which the card C is conveyed.

Each of the light condensing plates 52 is arranged in a manner covering the corresponding halogen lamp 51 and has left and right ends thereof supported by the respective heater-block frames 15. In this embodiment, the halogen lamps 51 are optical heat sources each generating light with short wavelengths, and hence the card C has its surfaces, i.e. the opposite ink image-receiving layers 92 properly heated while suppressing heat transmission to the substrate layer 90.

The heater-block conveyor device 17 is comprised of a pair of transport guides 60, 60 implemented by a plurality of guide rollers 68 arranged along the respective left and right sides of the transport passage 8 in a manner opposed to each other, and a heater-block conveyor belt mechanism 61 which conveys the card C in a manner pushing the same forward from behind with the card C being guided by the pair of transport guides 60, 60. The guide rollers 68 on-each side are arrayed in a manner such that the whole array extends from a location immediately downstream of the inversion/transfer device 19 to a location immediately upstream of the card exit 7. Each guide roller 68 is in the form of an hourglass having an intermediate portion thereof constricted and rotatably supported by a holder, not shown, attached to inner surfaces of the respective heater-block frame 15. The card C is supported by the constricted portions of the guide rollers 68 arrayed in two lines parallel and opposed to each other, such that it is sandwiched from the left and right sides thereof, and stably guided forward with free rotation of the guide rollers 68.

The heater-block conveyor belt mechanism 61 is comprised of a pair of driven pulleys 62, 62 arranged at respective locations upstream and downstream of the irradiation units 50, a drive pulley 63 arranged at a location below the lower irradiation unit 50 positioned below the transport passage 8, a heater-block drive motor 64 as a drive source for driving the drive pulley 63, and a heater-block conveyor belt 65 stretched around the pair of driven pulleys 62, 62 and the drive pulley 63. The driven pulleys 62, 62 and the drive pulley 63 are rotatably supported by respective pulley shafts, not shown, each having opposite ends thereof supported by the respective heater-block frames 15. The heater-block drive motor 64 is connected to the heater-side controller 18, for controlling rotation of the drive pulley 63, i.e. traveling of the heater-block conveyor belt 65.

The heater-block conveyor belt 65 is stretched such that it turns around the lower irradiation unit 50. The heater-block conveyor belt 65 is formed to have a small width, and has a plurality of (five, as viewed in FIG. 2) pushing pawls 67, formed on a surface thereof at predetermined space intervals. More specifically, the heater-block conveyor belt 65 is formed to have a width equal to the width of the magnetic encoder portion (magnetic stripes) of the card C and stretched in a state positioned with respect to the left-right direction such that the belt 65 can face the magnetic encoder portion of the transferred card C.

Thus, it is possible to align the heater-block conveyor belt 65 with a portion of the card C not requiring heat irradiation for image forming and fixation. Further, when the ink image-receiving layer 92 of the card C is partially laminated on the surface of the card C except the magnetic encoder portion thereof, the heater-block conveyor belt 65 blocks heat irradiation to the magnetic encoder portion of the card C, whereby it is possible to prevent thermal influence of heating against the magnetic encoder portion. In this connection, it is preferable that the heater-block conveyor belt 65 is formed of a heat resistant silicone.

Each pushing pawl 67 revolves around the lower irradiation unit 50 as the heater-block conveyor belt 65 moves. More specifically, the pushing pawl 67 comes into contact with the trailing end of the card C and revolves while pushing the card C. Accordingly, the card C brought to the heater device 16 and sent further toward the card exit 7 by being pushed forward by the moving pushing pawl 67 in a state supported and held in a horizontal position by the pair of transport guides 60, 60 on the respective left and right sides.

Further, the heater-block conveyor device 17 is provided with a pawl-detecting sensor 69 for detecting a pushing pawl 67. The pawl-detecting sensor 69 is connected to the heater-side controller 18, and determines the position of a pushing pawl 67 such that the pushing pawl 67 can be properly brought into contact with the trailing end of the card C so as to push the same. More specifically, the heater-side controller 18 controls such that a pushing pawl 67 immediately preceding the pushing pawl 67 which should push the card C is stopped at a predetermined position and functions as a stopper for stopping the card C transferred from the inversion/transfer device 19 in a manner flicked by the sender roller 80. As a result, the card C is transferred to the heater-block conveyor belt 65, with its trailing end positioned forward of a portion of the heater-block conveyor belt 65 positioned at the proximal end, which prevents the pushing pawl 67 for pushing the card C from failing to come into contact with the trailing end of the card C.

The heater-side controller 18 controls the heater device 16 and the heater-block conveyor device 17 based on results of detection by the printer-side controller 14. More specifically, the heater-side controller 18 determines the heating temperature and the conveying speed of the card C in the heater block 5, based on attribute information of the card C detected by the printer-side controller 14 (including the material of the substrate layer 90, the thickness of the entire card C, etc.).

In succession to the double-sided printing on the card C, the heater device 16 is driven by the heater-side controller 18 to perform heating at the predetermined heating temperature based on the attribute information of the card C, whereupon the heater-block conveyor device 17 carries the card C forward over a predetermined time period while passing the same through the heater device 16 at a conveying speed dependent on the heating temperature. Then, when the heater-block conveyor device 17 has sent the card C out of the apparatus 1 via the card exit 7, the operations of the heater-block conveyor device 17 and the heater device 16 are stopped. In this case, the control of the amount of heat applied to the card C may be simplified by controlling the heating temperature alone while holding constant the conveying speed at which the card C is conveyed by the heater-block conveyor device 17. Further, the conveying speed may be determined according to a printing resolution.

When the card C is discharged from the card exit 7 after the heat treatment of the both sides thereof as described above, the user peels off both of the ink image-receiving layers 92 to expose the ink-fixing layers 91 (or the fluorine film layers 93) to the outside, whereby the card C can be produced which has images fixed in both of the ink-fixing layers 91, that is, printed on the front and back surfaces of the card C.

According to the above-mentioned image forming apparatus 1 for printing images on a card, it is possible not only to carry out the doubled-sided printing of images on a card C by the printer device 11 through a sequence of operations within the casing 2 but also to fix print images in the card C by the heater device 16. This makes it possible to form clear images on the card C by the ink jet printing method as well as provide the card C printed with images with rub resistance without carrying out the laminating process on the images.

Although in the present embodiment, the mechanism for inverting a card C upside down is incorporated in the inversion/transfer device 19, this is not limitative, but only the mechanism (inverting means) for inverting the card C may be independently or separately provided on the proximal end side of the printer-block conveyor device 13. In this case, the card C having its front surface printed with an image is returned to the proximal end of the printer-block conveyor device 13 by the suction table 40 and then brought to the inverting means, where the card C is inverted, and then brought to the printer device 11, followed by being passed to the heater block 5.

Although in the present embodiment, the operation of peeling off the ink image-receiving layers 92 after the heat treatment is entrusted to the user, this is not limitative, but a peeling device for peeling off the ink image-receiving layers 92 may be accommodated in the casing 2. Further, although in the present embodiment, the case in which doubled-sided printing is carried out on a card C is described in detail, it goes without saying that it is possible to print on only one side of a card C and discharge the card C via the card exit 7. Further, the apparatus may be configured such that when the doubled-sided printing is carried out on a card C, the front surface of the card C is printed first, and then the card C is delivered from the card exit 7 so as to be introduced again into the feeder device 12 with its back surface-side up.

Figure 6:
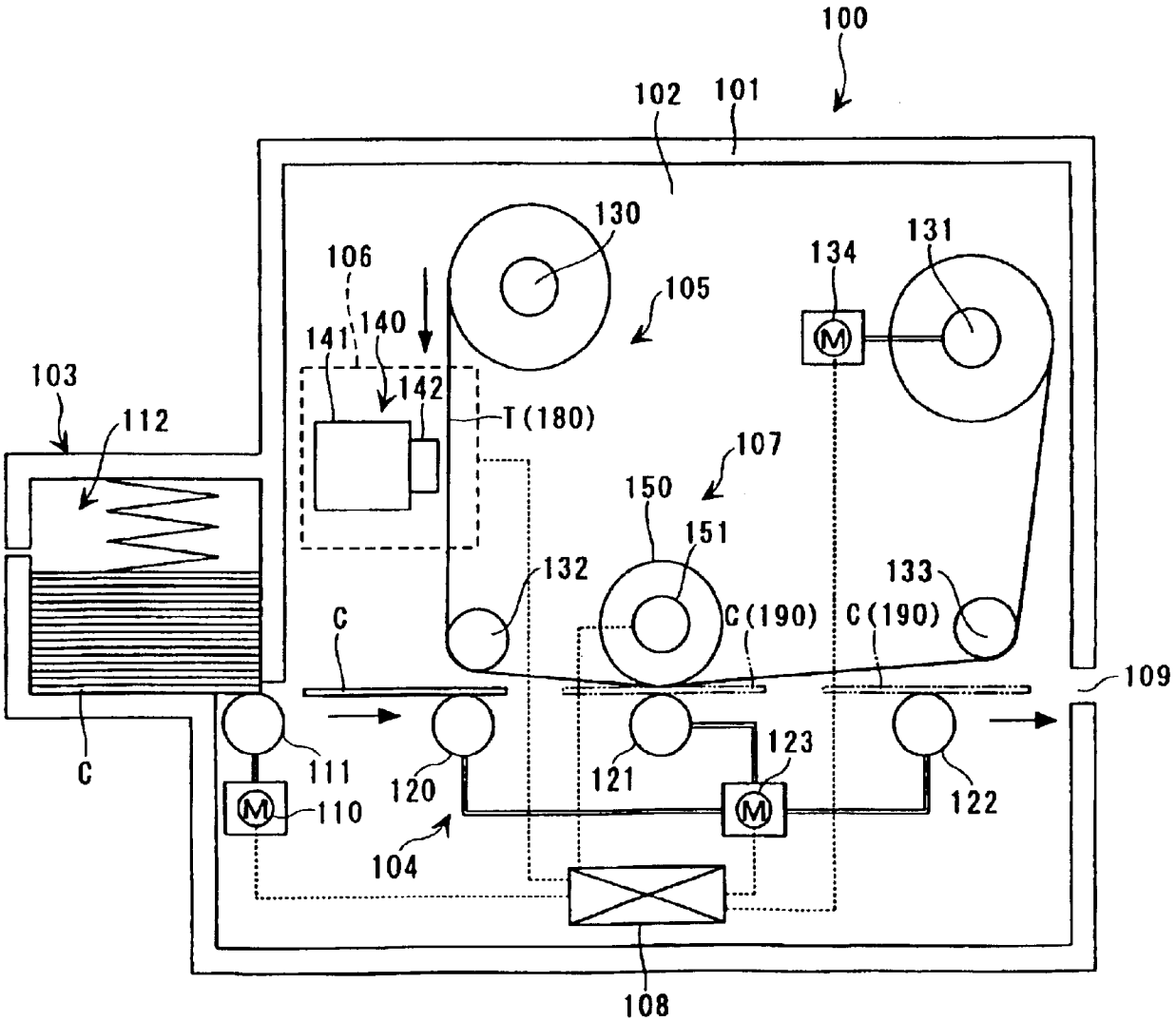
FIG. 6 is a cross-sectional view schematically showing the internal construction of an image forming apparatus for forming an image on a card, according to a second embodiment of the present invention.
Figure 7A:
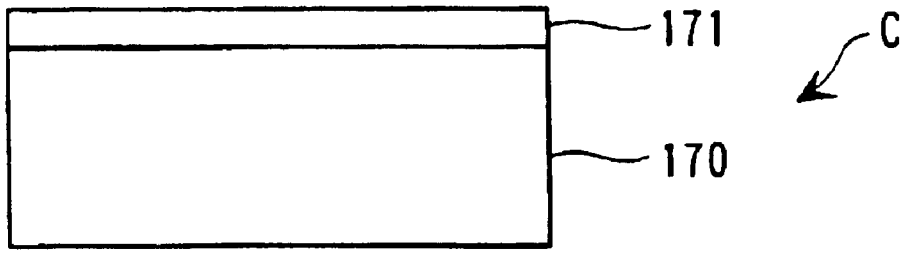
FIG. 7A is a cross-sectional view schematically showing the laminate structure of an inexpensive card used in a second embodiment.
Figure 7B:
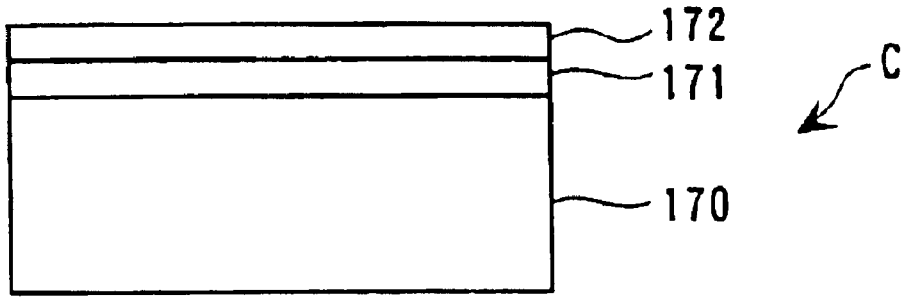
FIG. 7B is a cross-sectional view schematically showing the laminate structure of a high-grade card used in the second embodiment.
Figure 7C:
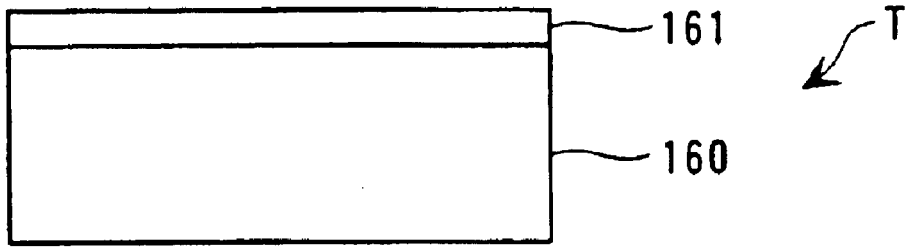
FIG. 7C is a cross-sectional view schematically showing the laminate structure of a transfer sheet used in the second embodiment.

Next, an image-forming apparatus and method for forming an image on a card according to a second embodiment of the invention will be described. This image-forming apparatus is quite different in construction from that of the first embodiment. The image-forming apparatus of the present embodiment thermally transfers an image printed on a transfer sheet T to a card C, thereby forming the image on the same. FIG. 6 is a cross-sectional view schematically showing the internal construction of the image forming apparatus according to the second embodiment. FIGS. 7A to 7C schematically show the laminate structures of an inexpensive card, a high-grade card, and a transfer card, respectively, used in the image forming apparatus.

As shown in FIG. 6, the image-forming apparatus 100 has an apparatus body 102 comprised of a box-shaped casing 101, card-feeding means 103 for feeding a card C, card conveyor means 104 for conveying the card C, a card exit 109 via which the card C is delivered out of the casing 101, sheet-feeding means 105 for feeding a transfer sheet T by unrolling a roll thereof, printing means 106 for printing on the transfer sheet T rolled out by the sheet-feeding means 105, thermal pressing means 107 for affixing the printed transfer sheet T to the card C by pressure while applying heat thereto, and a controller 108 for controlling these means. The image-forming apparatus 100 carries out printing of an image including characters, figures, and so forth on the transfer sheet T by the ink jet printing method using sublimable dye ink while feeding the transfer sheet T, and then affixing the printed portion of the transfer sheet T to a card C on which the portion is overlaid by pressure while applying heat thereto (hereinafter this process is referred to as "thermal pressing"), thereby causing fixing and color development of the image in the card C.

Now, each means of the image forming apparatus 100 will be described. Before describing them, the transfer sheet T and the card C will be first described in detail hereinafter, for purposes of ease of understanding of the following description. Referring to FIG. 7C, the transfer sheet T is comprised of a sheet substrate layer 160, and an ink image-receiving layer 161 laminated on the surface of the sheet substrate layer 160. The ink image-receiving layer 161 forms the printing surface of the transfer sheet T.

The sheet substrate layer 160 is formed of a resin material, such as PET or the like, or a synthetic paper so as to maintain the rigidity of the entire transfer sheet T. The ink image-receiving layer 161 is formed of a hydrophilic resin material which is capable of temporarily holding the sublimable dye ink directly printed thereon. When the transfer sheet T is heated, the sublimable dye ink held in the ink image-receiving layer 161 permeates deep into the sheet substrate layer 160 as migration particles having a size at a molecular level, to disappear from the ink image-receiving layer 161.

There are provided two types of cards C whose laminate structures are shown in FIGS. 7A and 7B. Each of the cards C is comprised of a card substrate layer 170, and an ink-fixing layer 171 laminated on the surface of the card substrate layer 170. It should be noted that the card C appearing in FIG. 7B is formed by further arranging a fluorine film layer 172 on the surface of the ink-fixing layer 171, that is, on the surface of the whole card C, as a substitute for a laminating film.

The card substrate layer 170 is formed of the same material, such as PET or the like, as that of the substrate layer of the cards C used in the first embodiment so as to maintain the rigidity of the entire card C. Further, the ink-fixing layer 171 is formed of the same material, such as a transparent PET film, as that of the ink-fixing layer 171 used in the first embodiment. The ink-fixing layer 171 is a layer into which the sublimable dye ink for printing is finally permeated.

More specifically, as shown in FIGS. 9A to 9D, when an image is printed on the transfer sheet T by the printing means 106 by the ink jet printing method, ink droplets of the sublimable dye ink are impregnated into the ink image-receiving layer 161 and held therein. Then, the printed portion of the transfer sheet T is aligned on the card C, and the thermal pressing is carried out in a state of the ink image-receiving layer 161 of the transfer sheet T and the ink-fixing layer 171 of the card C being overlaid upon each other, whereupon the ink droplets penetrate deep into the ink-fixing layer 171 as migration particles having sizes at a molecular level. In short, the ink droplets held in the ink image-receiving layer 161 undergoes evaporation and diffusion and develops color in the ink-fixing layer 171. Then, the transfer sheet T is separated (peeled off) from the card C to produce the card C having the image transferred to the ink-fixing layer 171.

It should be noted that if the FIG. 7B card C having the fluorine film layer 172 laminated thereon is employed, when the thermal pressing of the transfer sheet T is carried out, the ink droplets are filtered through the fluorine film layer 172 and undergoes diffusion and fixation in the ink-fixing layer 171. That is, when the card C having the transfer sheet T removed therefrom has the fluorine film layer 172 as a topmost layer thereof which protects the image fixed in the ink-fixing layer 171. Due to the characteristics of the fluorine film layer 172, the card C is made more excellent in weather resistance, light resistance, heat resistance, rub or abrasion resistance and chemical resistance, and hence provided with an increased gloss.

Next, the components of the image-forming apparatus 100 will be described in detail. The card feed means 103 is generally similar in construction to the card feeder 12 in the first embodiment and comprised of a feed motor 110 as a drive source, a feed roller 111 rotated by the feed motor 110, and a card cassette 112 containing a plurality of cards C in a stacked state. The feed roller 111 is constantly held in rolling contact with the underside surface (of the card substrate layer 170) of a lowermost card C of the stack so as to reliably feed the cards C one by one from the card cassette 112 onto the card conveyor means 104. For more details, the first embodiment should be referred to.

Similarly, the printing means 106 is generally similar in construction to the printer device 11 in the first embodiment. More specifically, the printing means 106 is comprised of a head unit 140, a carriage motor as a drive source, and a reciprocating mechanism which receives torque from the carriage motor to reciprocate the head unit 140. The head unit 140 is comprised of an ink jet head 142 having a plurality of nozzles formed in an underside surface thereof, an ink cartridge which supplies ink to the ink jet head 142, and a carriage 141 carrying the ink jet head 142 and the ink cartridge. Details of the printing means are omitted in FIG. 6.

In the present embodiment, similarly to the first embodiment, the carriage 141 is caused to reciprocate by the reciprocating mechanism, and during the reciprocating motion of the carriage 141, ink droplets are ejected from the ink jet head 142 as required, whereby printing is effected on the transfer sheet T. More specifically, in the present embodiment, while the transfer sheet T is intermittently fed to pass in front of the head unit 140 along a sheet traveling passage 180, the head unit 140 performs reciprocating motion in a direction orthogonal to the direction of feeding of the transfer sheet T, whereby printing is performed on the transfer sheet T. It should be noted that in the present embodiment, a mirror or reverse image of a desired image is printed on the transfer sheet T so as to form a normal image after it is transferred onto the card C.

The card conveyor means 104 is comprised of a transport roller 120, a press roller 121, and a discharge roller 122 arranged at respective upstream, intermediate, and downstream locations along a card transport passage 190 extending horizontally for communication between the card feed means 103 and the card exit 109, a drive motor 123 as a drive source, and a torque-transmitting mechanism, not shown, including a belt, gears, etc. for transmitting torque from the drive motor 123 to the rollers. In the present embodiment, the press roller 121 functions not only as a main component of the thermal pressing means 107, but also as a part of the card conveyor means 104 for sending the card C to the discharge roller 122.

When the card C is fed from the feed roller 111, the feed roller 120 rolls in rolling contact with the underside surface of the card C to transfer the same along the card transport passage 190 to the press roller 121. Further, the transport roller 120 rolls in synchronism with feed of the transfer sheet T by the sheet-feeding means 105 so as to transport the card C to the press roller 121 such that the printed portion of the transfer sheet T can be accurately aligned on the card C at a location facing the thermal pressing means 107.

The press roller 121 rolls in rolling contact with the underside surface of the card C to transfer the same along the card transport passage 190 to the discharge roller 122, and cooperates with a heat roller 150 to feed the card C by rotation in a state sandwiching the same therebetween. In other words, the card C is firmly pressed from opposite sides between the press roller 121 and the heat roller 150 via the transfer sheet T in a state of the ink-fixing layer 171 as an uppermost surface thereof facing toward the heat roller 150.

The discharge roller 122 rolls in rolling contact with the underside surface of the card C transferred from the press roller 121 to advance the card C along the card transport passage 190 and discharge the same via the card exit 109. The torque-transmitting mechanism causes the drive motor 123 as a single drive source to rotate the transport roller 120, the press roller 121 and the discharge roller 122 in a synchronous manner. In short, the card C is fed horizontally along the card transport passage 190 at a constant speed.

The sheet-feeding means 105 is comprised of a supply reel 130 for rolling out the transfer sheet T from a left-hand roll thereof as viewed in the figure, a take-up reel 131 for taking up the transfer sheet T into a right-hand roll thereof as viewed in the figure, a first guide roller 132 for guiding the transfer sheet T rolled out from a roll thereof on the supply reel 130 to the printing means 106, a second guide roller 133 for guiding the transfer sheet T from the first guide roller 132 to the thermal pressing means 107, and a take-up motor 134 for driving the take-up reel 131. The supply reel 130, the first guide roller 132 and the second guide roller 133 are rotatable members, and the first guide roller 132, the thermal pressing means 107 and the second guide roller 133 form the sheet traveling passage 180 from the supply reel 130 to the take-up reel 131.

The supply reel 130 is arranged at a location upstream of the printing means 106. A roll of the unused transfer sheet T is wound around the supply reel 130. The transfer sheet T is wound around the supply reel 130 with the sheet substrate layer 160 facing inside so as to cause the image-receiving layer 161 to face the head unit 140. The first guide roller 132 is arranged at a location downstream of the printing means 106 in a manner opposed to the transport roller 120 via the card transport passage 190. The supply reel 130 and the first guide roller 132 are disposed at the respective locations on vertically opposite sides of the printing means 106 and form the sheet traveling passage 180 parallel to the head unit 140, along which the transfer sheet T is fed.

The take-up reel 131 is driven for rotation by the take-up motor 134 to take up the transfer sheet T after subjected to the thermal pressing. More specifically, the transfer sheet T is rolled out from the supply reel 130 by rotation of the take-up reel 131 and taken up by the take-up reel 131. The second guide roller 133 is arranged between the take-up reel 131 and the heat roller 150 in a manner opposed to the discharge roller 122 via the card transport passage 190.

More specifically, the second guide roller 133 guides the transfer sheet T being taken up by the take-up reel 131 via the heat roller 150, such that the transfer sheet T is fed in an inclined or obliquely upward direction with respect to the card transport passage 190. In short, the second guide roller 133 not only guides the feed of the transfer sheet T but also serves as peeling means for peeling off the transfer sheet T which was affixed to the card C by the thermal pressing means 107, from the card C.

The thermal pressing means 107 is comprised of the press roller 121, the heat roller 150 opposed to the press roller 121 via the card transport passage 190 and the sheet traveling passage 180, and a heater 151 incorporated in the heat roller 150 and functioning as a heat source. The heat roller 150 has a predetermined length corresponding to the width of the card, and has pressure thereof adjusted by a spring, not shown, for urging the heat roller 150 toward the press roller 121. The heat roller 150 may be formed by a metal roller formed e.g. of stainless having a predetermined surface smoothness, but more preferably, it is formed by a heat-resistant rubber roller.

The heater 151 is connected to the controller 108 and uniformly keeps the heat in the heat roller 150 in a direction of its length. The sheet traveling passage 180 and the card transport passage 190 merge with each other between the heat roller 150 and the press roller 121, and at this merging point, the transfer sheet T and the card C are firmly pressed against each other from above and below and advanced at a constant speed with rotation of the two rollers.

The controller 108 includes a CPU performing various kinds of control processes, a ROM storing control programs and control data for controlling various means, a RAM used as a work area for carrying out the control processes, and driving circuits for driving the devices of the apparatus. Within the casing 101, there are arranged two sensors, not shown, connected to the controller 108 and facing the sheet traveling passage 180 at respective locations on vertically opposite sides of the printing means 106 and a sensor, not shown, facing the card transport passage 190 at a location close to the transport roller 120. The position of a printed portion of the transfer sheet T is detected by these sensors, and based on the sensed position of the printed portion, the printed portion of the transfer sheet T and a card C fed by the transport roller 120 are properly aligned with each other and passed through the thermal pressing means 107.

The detailed flow of operations for forming an image on a card C is follows. After printing is carried out on the transfer sheet T by the printing means 106, the transfer sheet T is fed to the heat roller 150 by the sheet-feeding means 105, while the card C delivered from the card feed means 103 is fed to the press roller 121 by the card conveyor means 104. At this time, the card C and the transfer sheet T are sandwiched between the heat roller 150 and the press roller 121, and the printed portion of the transfer sheet T is firmly pressed on the card C in a heated state. In other words, the heat roller 150 and the press roller 121 roll in rolling contact with the transfer sheet T and the card C along the width thereof while advancing the sheet T and the card C together. Then, the transfer sheet T is taken up while being peeled off the card C, whereas the card C having the image fixedly formed thereon is discharged via the card exit 109 to the user.

Figure 8A:
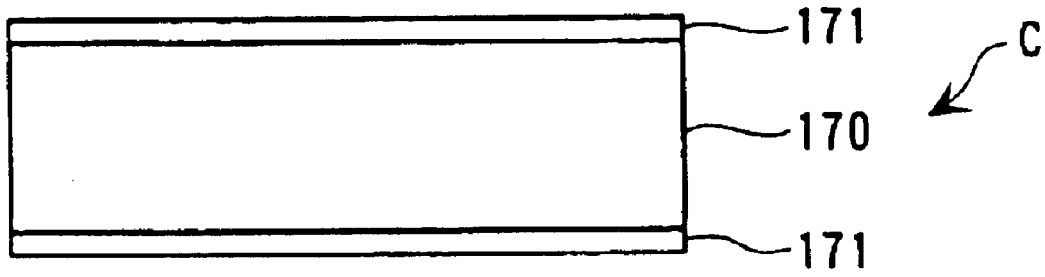
FIGS. 8A and 8B are cross-sectional views schematically showing the laminate structures of other cards.
Figure 8B:
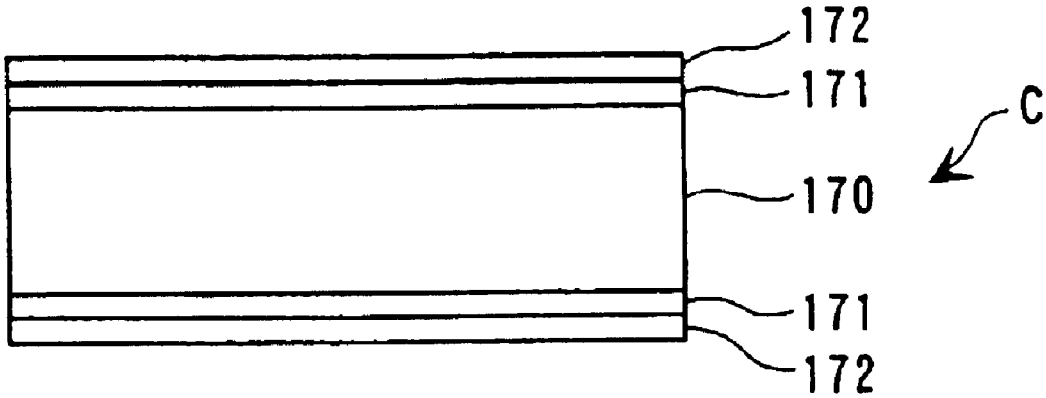
Figure 9A:
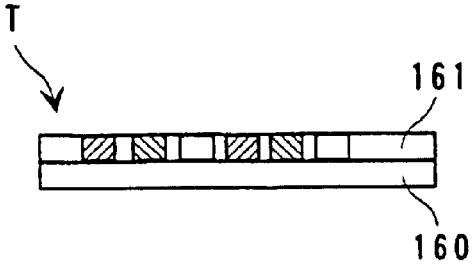
Figure 9B:
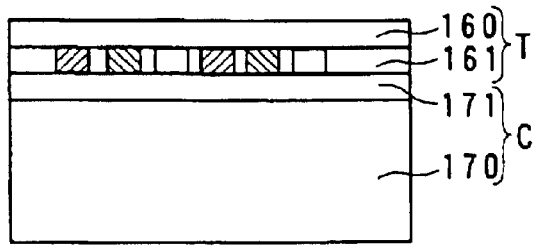
Figure 9C:
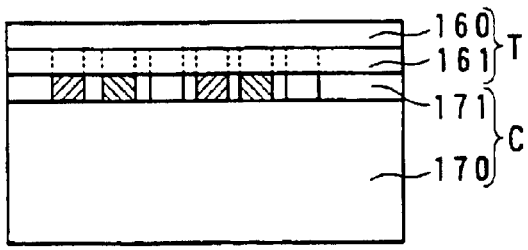
Figure 9D:
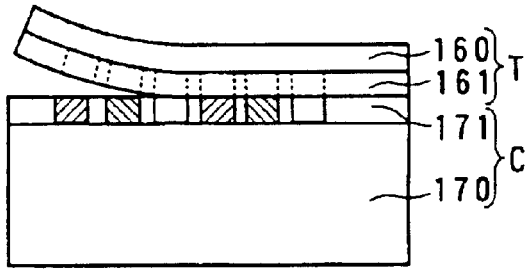
Figure 10:
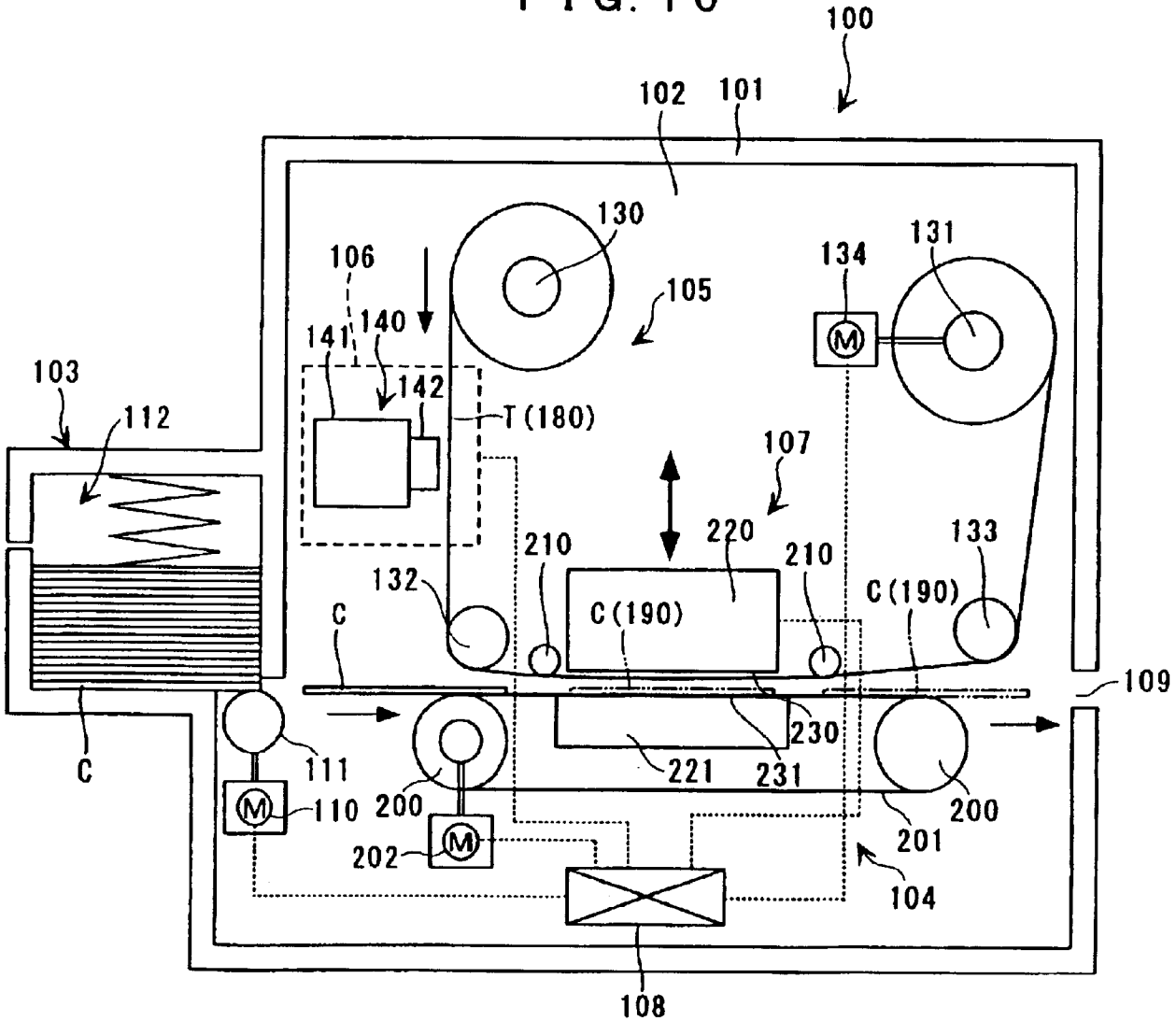
FIG. 10 is an image forming apparatus for forming an image for a card, according to a third embodiment of the invention.

It should be noted that as shown in FIG. 8B, if the card C includes the substrate layer 170 and layers laminated with the same materials with the laminated layers being arranged on opposite sides of the substrate layer 170, and can be used for doubled-sided printing, printing operation may be performed as follows. First, the front surface of the card C is printed, the card C is delivered from the card exit 109, and thereafter the card C is introduced onto the card feed means 103 again with its back surface-side up.

Further, a sheet cartridge which is formed by accommodating the supply reel 130, the take-up reel 131, and the transfer sheet T in a single cartridge casing may be removably mounted in the casing 101. In this case, the sheet cartridge may be configured such that it has a sheet traveling passage 180 for the transfer sheet T within the cartridge casing, and openings in portions corresponding to the heat roller and the head unit 140. This makes it possible to facilitate handling of the apparatus, such as storage of the transfer sheet T, when the apparatus is transported.

Next, an image forming apparatus for forming an image on a card, according to a third embodiment will be described. This embodiment is a variation of the second embodiment. More specifically, the apparatus according to the third embodiment is different from the second embodiment in construction of card conveyor means 104, sheet feed means 105, and thermal pressing means 107. In the following, description of the same component parts is omitted, and the above means will be briefly described.

A card conveyor means 104 is comprised of a pair of pulleys 200, 200 arranged in parallel with a card transport passage 190 at respective locations upstream of and downstream of the thermal pressing means 107, a conveyor belt 201 stretched between the pair of pulleys 200, 200, and a belt motor 202 for driving the conveyor belt 201 by rotation of one of the pulleys. The pulley 200 on the upstream side is arranged in the vicinity of a supply roller 111 in a manner opposed to a first guide roller 132 via the card transport passage 190. The pulley 200 on the downstream side is arranged in the vicinity of the card exit 109. The belt motor 202 as a drive source is connected to the controller 108 for controlling travel of the conveyor belt 201.

The conveyor belt 201 formed by a heat resistant silicone has a width corresponding to the width of the card C. Further, the conveyor belt 201 forms a horizontal card transport passage 190 arranged at a location immediately under a thermal pressing device 220 of the thermal pressing means 107. The conveyor belt 201 is stretched such that it turns around a press-receiving base 221, and at the same time slidably travels on the top surface of the press-receiving base 221. The card C is passed from the supply roller 111 to the conveyor belt 201, carried through the thermal pressing means 107 in parallel with the card transport passage 190, and further delivered from the conveyor belt 201 to the card exit 109 via.

The sheet feed means 105 further includes a pair of passage projections 210, 210 arranged along the sheet traveling passage 180 at respective locations upstream of and downstream of the thermal pressing device 220. The pair of passage projections 210, 210 are arranged in parallel with the sheet traveling passage 180 so as to position the transfer sheet T in parallel with the card transport passage 190. That is, the transfer sheet T printed with an image and sent in a manner such that travel thereof is guided by the passage projection 210 on the upstream side has an ink image-receiving layer 161 facing toward the card C on the conveyor belt 201 in parallel therewith and a sheet substrate layer 160 facing toward the pressing surface 230 of the thermal pressing device 220, in parallel therewith, between the pair of passage projections 210, 210.

The thermal pressing means 107 includes the thermal pressing device 220, and a press bearer 221 arranged in a manner parallel and opposed to the thermal pressing device 220 via the card transport passage 190 and the sheet traveling passage 180. The thermal pressing device 220 has the pressing surface 230 parallel to the card transport passage 190, and slightly larger in size than the surface of the card C. The thermal pressing device 220 is connected to the controller 108, and capable of moving in upward and downward directions. In short, the thermal pressing device

220 has the heating temperature of the pressing surface 230 adjusted by the controller 108 while being moved downward by a lift mechanism, not shown, for pressing the pressing surface 230 against the press-receiving base 221 in a manner sandwiching the transfer sheet T and the card C therebetween.

The press-receiving base 221 has a press-receiving surface 231 corresponding and parallel to the pressing surface 230, and is surrounded by the conveyor belt 201 traveling therearound. More specifically, the press-receiving surface 231 of the press-receiving base 221 is located close to the surface of the conveyor belt 201 traveling above the base 221, such that the press-receiving base 221 can cooperate with the thermal pressing device 220 to perform the thermal pressing of the transfer sheet T to the card C. Further, it is preferred that the pair of passage projections 210, 210 as well are configured to be capable of moving vertically together with the thermal pressing device 220.

According to the above construction, the feed of the card C carried by the conveyor belt 201 and the transfer sheet T rolled out from the supply reel 130 and printed with an image is once stopped at the location of the thermal pressing means 107. That is, the printed portion of the transfer sheet T and the card C are completely positioned or aligned with each other between the pair of pulleys 200, 200. At this time, the card C is firmly urged from a transfer sheet side to have the printed portion of the transfer sheet T overlaid thereon and pressed thereagainst.

This causes the card C to be brought into surface contact with the pressing surface 230 such that the entire area of the surface of the card C can be uniformly heated and pressed, whereby the image printed on the transfer sheet is transferred to the ink-fixing layer 171. This makes it possible not only to ensure intimate contact between the card C and the transfer sheet T to thereby obtain the image of high quality, but also to transfer the print image from the transfer sheet T to the card C efficiently in a short time period.

It is further understood by those skilled in the art that the foregoing are preferred embodiments of the invention, and that various changes and modifications may be made without departing from the spirit and scope thereof.

What is claimed is:

1. An apparatus for forming an image on a card, comprising:

sheet feed means for feeding a transfer sheet along a traveling passage, said transfer sheet having a substrate layer, and an ink image-receiving layer laminated on a surface of the ink image-receiving layer;

printing means arranged to face said traveling passage, for printing an image on the transfer sheet in synchronism with feed of the transfer sheet, by an ink jet printing method by using a sublimable dye ink;

card conveyor means for conveying a card along a transport passage, the card having a substrate layer, and an ink-fixing layer laminated on a surface of the substrate layer; and thermal pressing means arranged to face a confluent portion of said traveling passage and said transport passage, for positioning and overlaying an image-formed portion of the transfer sheet to the ink-fixing layer of the card, and affixing the transfer sheet to the card by pressure while applying heat thereto, to thereby cause diffusion of the sublimable dye ink held in the ink image-receiving layer in the ink-fixing layer and color development to form an image;

peeling means arranged at a location downstream of said thermal pressing means, for peeling the transfer sheet off the card; and a single casing for accommodating said sheet feed means, said printing means, said card conveyor means, said thermal pressing means, and said peeling means.

2. An apparatus according to claim 1, wherein said printing means prints a mirror image of the image on the transfer sheet such that an image transferred therefrom onto the card forms a normal image.

3. An apparatus according to claim 1, wherein a fluorine film layer is laminated on a surface of said ink-fixing layer of the card.

4. An apparatus according to claim 1, further including card supply means for storing a plurality of the cards in a stacked fashion and supplying the cards one by one to said card conveyor means.

5. An apparatus according to claim 2, wherein said sheet feed means includes a supply reel for unrolling a roll of the transfer sheet wound therearound, and a take-up reel for taking up the transfer sheet unrolled, wherein the transfer sheet is unrolled from said supply reel, sent along said traveling passage, peeled off the card, and then taken up by said take-up reel.

6. An apparatus according to claim 5, wherein said traveling passage is formed by a cartridge casing, and wherein said supply reel, said take-up reel, and the transfer sheet are accommodated in said cartridge casing to form a sheet cartridge.

7. An apparatus according to claim 2, wherein said thermal pressing means comprises a pair of rollers which sandwich the transfer sheet and the card overlaid upon each other therebetween, and advances the sheet and the card at a constant speed in accordance with rotation thereof, at least one of the rollers toward the transfer sheet being a heating roller.

8. An apparatus according to claim 2, wherein said thermal pressing means is formed by a hot-pressing mechanism for sandwiching an image-formed portion of the transfer sheet and the card overlaid upon each other, and applying heat thereto.

* * * * *